US012498193B2

(12) United States Patent
Jolley et al.

(10) Patent No.: US 12,498,193 B2
(45) Date of Patent: Dec. 16, 2025

(54) ARCHERY BOW AND RELATED APPARATUSES

(71) Applicant: HOYT ARCHERY, INC., Salt Lake City, UT (US)

(72) Inventors: Gideon S. Jolley, Syracuse, UT (US); Andrew L. Unsworth, Bountiful, UT (US); Dan'l J. Anselmo, South Jordan, UT (US)

(73) Assignee: HOYT ARCHERY, INC., Salt Lake City, UT (US)

( * ) Notice: Subject to any disclaimer, the term of this patent is extended or adjusted under 35 U.S.C. 154(b) by 127 days.

(21) Appl. No.: 18/315,306

(22) Filed: May 10, 2023

(65) Prior Publication Data

US 2023/0375301 A1 Nov. 23, 2023

Related U.S. Application Data

(60) Provisional application No. 63/343,636, filed on May 19, 2022.

(51) Int. Cl.
*F41B 5/14* (2006.01)
*F41B 5/10* (2006.01)

(52) U.S. Cl.
CPC ..... *F41B 5/143* (2013.01); *F41B 5/10* (2013.01)

(58) Field of Classification Search
CPC .... F41B 5/143; F41B 5/10; F41B 5/00; F41B 5/105
USPC ..... 124/25.6
See application file for complete search history.

(56) References Cited

U.S. PATENT DOCUMENTS

| | | | | |
|---|---|---|---|---|
| 5,606,961 | A * | 3/1997 | Basik | F41B 5/143 124/44.5 |
| 8,936,477 | B1 * | 1/2015 | Kerrigan | H01R 43/205 439/157 |
| 9,726,453 | B1 * | 8/2017 | Hamm | F41B 5/143 |
| 2006/0157038 | A1 * | 7/2006 | Ellig | F41B 5/143 124/44.5 |
| 2008/0168971 | A1 * | 7/2008 | Mizek | F41B 5/143 124/44.5 |
| 2009/0101127 | A1 * | 4/2009 | Johnson | F41B 5/143 124/44.5 |
| 2014/0174420 | A1 * | 6/2014 | Khoshnood | F41B 5/143 124/44.5 |
| 2016/0341512 | A1 * | 11/2016 | Grace, Jr. | F41B 5/143 |
| 2017/0003096 | A1 * | 1/2017 | Ellig | F41B 5/143 |
| 2018/0058798 | A1 * | 3/2018 | Coalson | F41B 5/143 |
| 2019/0353448 | A1 * | 11/2019 | Garretson | F41B 5/105 |

* cited by examiner

*Primary Examiner* — John E Simms, Jr.
(74) *Attorney, Agent, or Firm* — DORSEY & WHITNEY LLP

(57) ABSTRACT

An arrow rest for an archery bow can include a housing, a biasing element, and a member or wheel that rotates between states, configurations, or orientations. The member can be rotated from a first orientation to a second orientation when the archery bow is at least partially drawn. While the member is in the second orientation, the biasing element can apply a torque retaining the member in the second orientation. The member can be rotated to a third orientation and released to generate momentum. A relatively large momentum of the member causes the member to rotate from the third orientation, past the second orientation, to the first orientation. A relatively small momentum of the member can cause the member to rotate from the third orientation to the second orientation.

20 Claims, 31 Drawing Sheets

ARCHERY BOW AND RELATED APPARATUSES

RELATED APPLICATION

This application claims the benefit of U.S. Provisional Application No. 63/343,636, filed on 19 May 2022, which is hereby incorporated by reference herein in its entirety.

TECHNICAL FIELD

The present disclosure generally relates to archery equipment and specifically relates to incorporating momentum activated rotatable members into archery equipment.

BACKGROUND

Bowhunters and other archers use finely tuned archery equipment to launch arrows and other projectiles down range. For example, compound bows include one or more eccentrics or cams which rotate as the archer draws the archery bow to bend or flex limbs of the archery bow. While bent or flexed, the limbs of the archery bow provide potential energy transferred to the projectile through the bowstring when the projectile is launched. Greater amounts of energy and a more efficient transfer of the energy to the projectile can result in increased flight speed and greater kinetic energy transferred to the target upon impact of the projectile. Accordingly, there is a constant need for improvements to various types of archery equipment relating to generating and storing energy for launching the projectile.

Archery equipment, such as recurve bows, crossbows, and compound bows, are regularly used to launch arrows and other projectiles down range at one or more targets. Components of the archery bow work in unison to provide accurate and repeatable arrow flight while also providing a desirable user experience (e.g., satisfactory vibration and sound characteristics). Archery accessories, such as an arrow rest, can be affixed to the archery bow to increase utility and directly impact user satisfaction. Components and accessories for archery bows can be improved to advantageously impact an archer's shooting experience, performance, and overall satisfaction with the archery equipment.

SUMMARY

One aspect of the present disclosure relates to an arrow rest for an archery bow including a housing, a biasing element, a member, and an arrow support. The housing defines an internal volume. The biasing element is at least partially disposed within the internal volume. The member is coupled to the biasing element and rotatable about an axis of rotation in a first direction from a first orientation to a second orientation. The biasing element applies a first torque on the member which biases the member to remain in the second orientation. The member is rotatable in the first direction from the second orientation to a third orientation. The biasing element contacts a protrusion in the third orientation. The biasing element applies a second torque on the member in the third orientation which biases the member to rotate in a second direction. The arrow support is coupled to the member.

In some embodiments, the member can be rotatable in the second direction from the third orientation to the second orientation. The second torque can generate an angular momentum sufficient to overcome the first torque to rotate the member in the second direction from the third orientation, past the second orientation, to the first orientation.

In some embodiments, the biasing element can be a first biasing element and the arrow rest can include a second biasing element. The member can contact the second biasing element in the third orientation. The member can rotate in a second direction from the third orientation to the second orientation. The second biasing element can generate an angular momentum of the member sufficient to overcome the first torque to rotate the member in the second direction from the third orientation, past the second orientation, to the first orientation. In some examples, the second biasing element can be a compressive spring.

In some embodiments, the protrusion has a distal end and a proximal end. The proximal end of the protrusion can be coupled to the member. In some embodiments, the protrusion is offset a distance from the axis of rotation. In some embodiments, the biasing element can be a torsion spring coupled to the housing and the member. In some embodiments, the biasing element can be a tension spring coupled to the housing and the member.

Another aspect of the present disclosure relates to an arrow rest for an archery bow including a housing, a biasing element, a member, and an arrow support. The housing defines an internal volume. The member is disposed within the internal volume and rotatable about an axis of rotation. In a first configuration, the member is biased to rotate in a first direction. In a second configuration, the biasing element induces a torque biasing the member to remain stationary. In a third configuration, the biasing element biases the member to rotate in a second direction different from the first direction. The arrow support is coupled to the member.

In some embodiments, the arrow support can be in a first orientation relative to the housing while the member is in the first configuration. The arrow support can be in a second orientation relative to the housing while the member is in the second configuration. The arrow support can be in a third orientation relative to the housing while the member is in the third configuration.

In some embodiments, the biasing element can be at least partially disposed within the internal volume. In some embodiments, the member can rotate at least 70 degrees when the member transitions between the first configuration and the second configuration. In some embodiments, the biasing element can be a torsion spring or a tension spring. In some embodiments, the member includes a base portion, a stand-off, and an engagement portion. The stand-off can be coupled to the base portion. The base portion and the stand-off can form an undercut region or cutout region. The engagement portion can be coupled to the stand-off.

In some examples, the torque can correlate to a minimum threshold to rotate the member in the second direction from the third configuration to the first configuration. The member can generate a momentum while rotating in the second direction that is greater than the minimum threshold. In some embodiments, the biasing element can be a first biasing element and the arrow rest can include a second biasing element. The member can contact the second biasing element in the third configuration. The second biasing element can generate an angular momentum of the member sufficient to overcome the torque to rotate the member in the second direction from the third configuration, past the second configuration, to the first configuration.

In yet another aspect of the present disclosure, an arrow rest for an archery bow includes a housing, an arrow support, a biasing element, and a member. The housing defines an internal volume. The biasing element is disposed within the internal volume. The member is coupled to the biasing element and rotatable about an axis of rotation in a first direction. The biasing element applies a torque on the member. The arrow support is coupled to the member. A direction of the rotation the torque induces the member to rotate is dependent on the orientation of the member.

In some embodiments, the biasing element is a primary biasing element and the arrow rest includes a secondary biasing element. The member can be rotatable from a first orientation to a second orientation. The member can be rotatable from the second orientation to a third orientation. The member can contact the secondary biasing element in the third orientation. The secondary biasing element can generate an angular momentum of the member sufficient to rotate the member from the third orientation, past the second orientation, to the first orientation. In some examples, the primary biasing element can be a tension spring and the secondary biasing element can be a compression spring or magnet. In some examples, the primary biasing element can be a tension spring and the secondary biasing element can be a torsion spring.

Another aspect of the present disclosure relates to an archery bow including a riser, a first limb, a second limb, a first cam, a second cam, a bowstring, and a member. The first limb can be coupled to a first end of the riser. The second limb can be coupled to a second end of the riser. The first cam can be rotatably coupled to the first limb. The second cam can be rotatably coupled to the second limb. The bowstring can extend between the first cam and the second cam. The member can be coupled to a cable and can rotate about an axis of rotation in a first direction from a first orientation to a second orientation. The cable can apply a force biasing the member to remain in the second orientation. The member can be rotatable in the first direction from the second orientation to a third orientation.

In some embodiments, the member can be rotatable in a second direction from the third orientation to the second orientation. An angular momentum of the member can enable the member to overcome the force to rotate in the second direction from the third orientation, past the second orientation, to the first orientation. A respective distal end of one or more of the first limb or the second limb can be displaced as the member rotates from the first orientation to the second orientation. In some examples, the archery bow can further include a spring coupled to the cable and configured to tension the cable. The tension of the cable can vary as the member rotates between the first orientation and the second orientation.

In some examples, the cable can be a first length while the member is in the first orientation and elastically deform to a second length while the member is in the second orientation. In some examples, the first cam or the second cam can be rotatable about the axis of rotation. In some examples, the archery bow can further include a bracket coupled to the riser and extending from the riser toward the bowstring. The member can be rotatably coupled to the bracket.

In some examples, the cable can be a first cable and the archery bow further includes a second cable coupled to the member. Rotation of the member from the first orientation to the second orientation can cause the second cable to unwind from the member. Rotation of the member from the first orientation to the second orientation can cause the first cable to be entrained within one or more grooves formed on the member. A tension in the second cable can decrease as the member rotates from the first orientation to the second orientation.

In some examples, a segment of the cable can temporarily intersect the axis of rotation as the member rotates between the first orientation and the second orientation. In some examples, the axis of rotation can define a plane. The segment of the cable can be on a first side of the plane while the member is in the first orientation. The segment of the cable can be on a second side of the plane while the member is in the second orientation.

Another aspect of the disclosure relates to an archery bow including a riser, a first limb, a second limb, a first cam, a second cam, a bowstring, and an assembly. The first limb can be coupled to a first end of the riser. The second limb can be coupled to a second end of the riser. The first cam can be rotatably coupled to the first limb. The second cam can be rotatably coupled to the second limb. The bowstring can extend between the first cam and the second cam. The assembly can include a wheel, an energy storage device, and a cable. The wheel can be rotatable about an axis of rotation. The cable can be coupled to the wheel and the energy storage device. In a first configuration of the assembly, the wheel is biased to rotate in a first direction. In a second configuration of the assembly, the cable and the energy storage device can induce a torque biasing the wheel to remain stationary. In a third configuration of the assembly, the cable and the energy storage device can bias the wheel to rotate in a second direction different from the first direction.

In some examples, the cable can be a first cable and the assembly can further include a second cable. In the first configuration of the assembly, the second cable can bias the wheel to rotate in the first direction. In some examples, the energy storage device can be at least one of a coiled spring, a leaf spring, or a flexible beam. The assembly can have a potential energy in the third configuration that is greater than the torque biasing the assembly from transitioning from the second configuration to the first configuration. Transitioning the assembly from the third configuration to the second configuration can generate an angular momentum of the wheel greater than the torque. In some examples, the assembly can be configured to store potential energy in the second configuration. The assembly can be configured to convert the potential energy to kinetic energy and transfer at least a portion of the kinetic energy to a projectile launched from the archery bow.

Yet another aspect of the disclosure relates to an archery bow including a riser, a first limb, a second limb, a first cam, a second cam, a bowstring, a wheel, a first cable, and a second cable. The first limb can be coupled to a first end of the riser. The second limb can be coupled to a second end of the riser. The first cam can be rotatably coupled to the first limb. The second cam can be rotatably coupled to the second limb. The bowstring can extend between the first cam and the second cam. The wheel can be rotatable about an axis of rotation from a first orientation to a second orientation. The first cable can be coupled to the wheel and the first cam. The first cable can have a first tension while the wheel is in the first orientation and a second tension that is less than 10% of the first tension while the wheel is in the second orientation. The second cable can be coupled to the wheel and the second cam.

In some examples, the second tension can be 5% of the first tension. In some examples, the wheel can be rotatable to a third orientation. The first cable can have a third tension while the wheel is in the third orientation. The third tension can be greater than the second tension. In some examples, as the wheel rotates from the third orientation to the first orientation, an angular momentum of the wheel meets or exceeds an angular momentum threshold. The angular momentum threshold can correlate to a torque induced on the wheel by the first cable and inhibiting the wheel from rotating out of the second orientation. The torque can prevent the wheel from rotating from the second orientation to the first orientation while the angular momentum is less than the angular momentum threshold. In some examples, the wheel can rotate from the first orientation to the second orientation while the bowstring is drawn. The wheel can rotate from the second orientation to the third orientation while the bowstring is drawn. The wheel can rotate from the third orientation to the first orientation when the bowstring is released by a user when the bowstring is in a drawn configuration.

Another aspect of the present disclosure relates to an archery bow including a riser, a first limb, a second limb, a first cam, a second cam, a bowstring, and a member. The first limb can be coupled to a first end of the riser. The second limb can be coupled to a second end of the riser. The first cam can be rotatably coupled to the riser. The second cam can be rotatably coupled to the riser. The bowstring can extend between the first cam and the second cam. The member can be coupled to a cable and can rotate about an axis of rotation in a first direction from a first orientation to a second orientation. The cable can apply a force biasing the member to remain in the second orientation. The member can be rotatable in the first direction from the second orientation to a third orientation.

In some embodiments, the member can be rotatable in a second direction from the third orientation to the second orientation. An angular momentum of the member can enable the member to overcome the force to rotate in the second direction from the third orientation, past the second orientation, to the first orientation. A respective distal end of one or more of the first limb or the second limb can be displaced as the member rotates from the first orientation to the second orientation. In some examples, the archery bow can further include a spring coupled to the cable and configured to tension the cable. The tension of the cable can vary as the member rotates between the first orientation and the second orientation.

In some examples, the cable can be a first length while the member is in the first orientation and elastically deform to a second length while the member is in the second orientation. In some examples, the first cam or the second cam can be rotatable about the axis of rotation. In some examples, the archery bow can further include a bracket coupled to the riser and extending from the riser toward the bowstring. The member can be rotatably coupled to the bracket.

In some examples, the cable can be a first cable and the archery bow further includes a second cable coupled to the member. Rotation of the member from the first orientation to the second orientation can cause the second cable to unwind from the member. Rotation of the member from the first orientation to the second orientation can cause the first cable to be entrained within one or more grooves formed on the member. A tension in the second cable can decrease as the member rotates from the first orientation to the second orientation.

In some examples, a segment of the cable can temporarily intersect the axis of rotation as the member rotates between the first orientation and the second orientation. In some examples, the axis of rotation can define a plane. The segment of the cable can be on a first side of the plane while the member is in the first orientation. The segment of the cable can be on a second side of the plane while the member is in the second orientation.

The above summary of the present invention is not intended to describe each embodiment or every implementation of the present invention. The Figures and the detailed description that follow more particularly exemplify one or more preferred embodiments. The wheel can rotate from the third orientation to the second orientation and remain in the second orientation when the bowstring is let down from the drawn configuration.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1A:
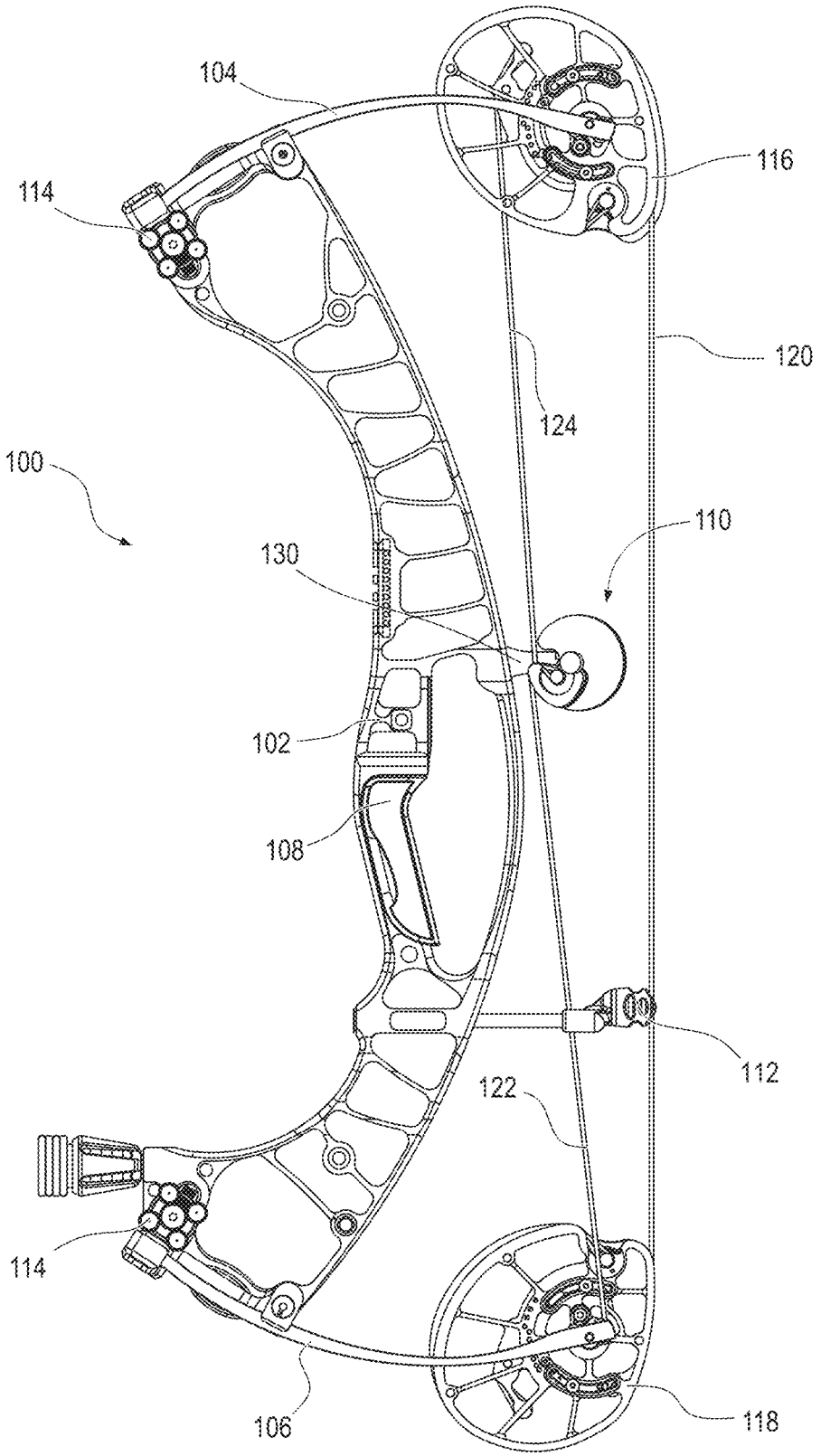
FIG. 1A is a side view of an archery bow in a brace state.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to a member, such as, a cam, wheel, eccentric, or other member incorporated into an archery bow or archery bow accessory, such as an arrow rest. In one aspect of the present disclosure, one or more members can be affixed to the archery bow and rotate to store and release energy. For example, the member can be rotated from a first configuration to a second configuration when the archery bow is at least partially drawn by the archer. Additionally, or alternatively, the member can be rotated from the first configuration to the second configuration by a lever or other tool that can be affixed to the member and turned by the archer. While the member is in the second configuration, a cable or other linkage coupled between the member and an energy storage device (e.g., one or more limbs, springs, or other elastically deformable elements) can displace, elongate, flex, or bend the energy storage device to generate potential energy. In some examples, the cable can be taken up and or let out of the member such that the cable exerts a force or torque on the member that biases the member to remain in the second configuration and thereby releasably store potential energy while the member is in the second configuration. For example, a segment of the cable can be repositioned relative to an axis of rotation of the member as the member is rotated such that the cable exerts a force or torque on the member biasing the member to remain in the second configuration.

In some examples, the archer can draw the archery bow (e.g., pull the bowstring from a brace position) to implement rotation of the member from the first configuration to the second configuration. The archer can further draw the archery bow to rotate the member from the second configuration to a third configuration. Rotation to the third configuration can generate a moment biasing the rotating member to rotate back toward the second configuration when the archer releases the bowstring. After the bowstring is released, a resultant momentum of the member can be sufficient to overcome the force exerted by the cable biasing the member to remain in the second configuration and enable the member to rotate past the second configuration to the first configuration, thereby converting potential energy into kinetic energy that is transferred to the projectile. In some examples, the archer can let the bowstring down relatively slowly such that the member does not have a threshold momentum required to overcome the force biasing the member to remain in the second configuration. In these examples, the member can return to the second configuration and retain the potential energy stored by displacing, elongating, flexing, or bending the energy storage device for a subsequent shot.

In some examples, the member can function as an actuator for transferring the potential/kinetic energy into a projectile launched from the archery bow without requiring a trigger, button, lever, or other mechanism that must receive direct input from the archer to actuate. In other words, the member can automatically transfer the potential energy from the energy storage device into a projectile when the momentum of the member meets or exceeds the threshold momentum (i.e., when the bowstring is drawn and released by the archer). However, the member can automatically return to the second configuration (i.e., a configuration that does not release the potential energy) if the archer slowly lets the bowstring down such that the momentum of the member does not meet or exceed the threshold momentum (i.e., when the bowstring is drawn and let down relatively slowly by the archer).

In some use cases, an archer may desire to preemptively store energy by at least partially drawing the bowstring with the intention of energizing the member (i.e., causing the member to rotate and releasably store potential energy). For example, the archer can draw or pull the bowstring a quarter or half the distance required to fully draw the bowstring. Thereafter, the archer can let the bowstring down before fully drawing the bowstring with the intention of launching a projectile. In some examples, the archer can energize the member by rotating the member from a first orientation to a second orientation using a lever or other hand tool.

In some examples, an archer incapable of pulling back an archery bow having a relatively large draw weight can rely on the additional energy provided by energizing the member to achieve a desired draw weight that would otherwise not be attainable by the archer (e.g., shooting 80 pounds of draw weight when the archer is only physically capable of pulling 60 pounds of draw weight). In this case, a projectile can be launched with more force than the archer is physically capable of inputting into an archery bow without the member. Additionally, or alternatively, an archer capable of pulling back an archery bow having a relatively large draw weight can reduce the draw weight to a more comfortable level to enable the archer to take more shots with less fatigue (e.g., repeatedly launching the projectile at 70 pounds of draw weight while only having to draw or pull 50 pounds of weight).

Figure 4A:
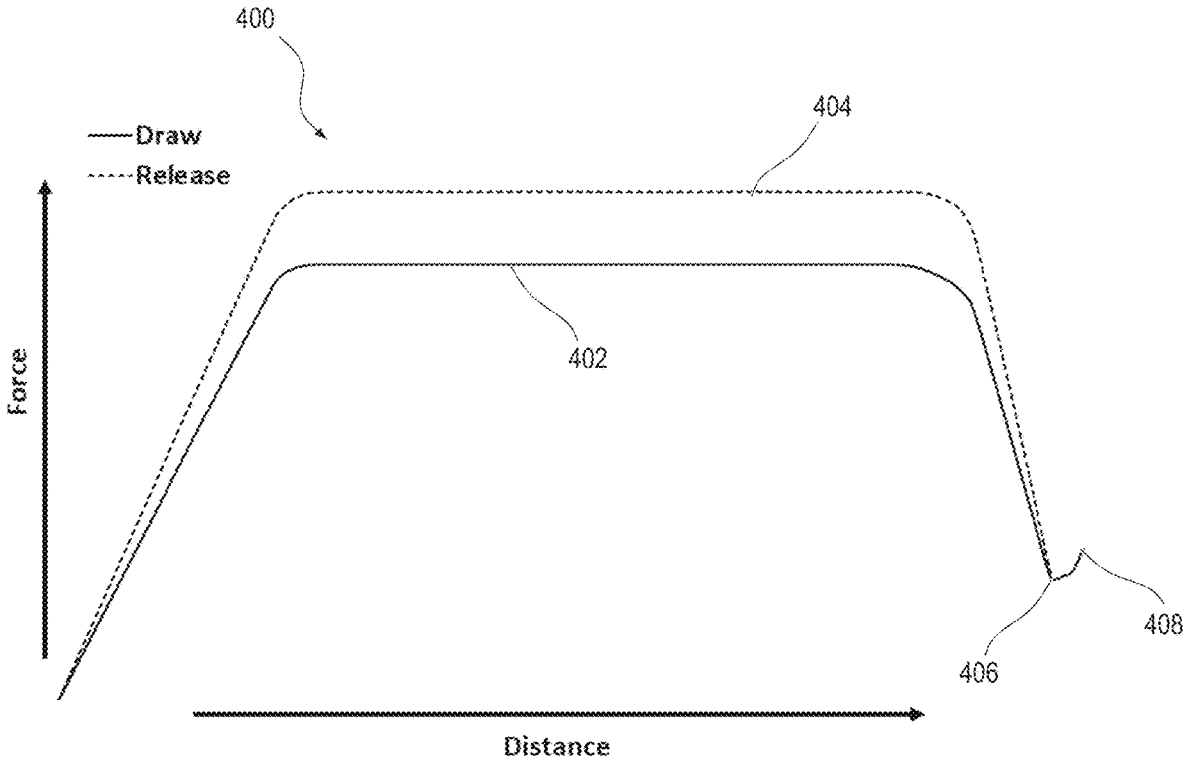
FIG. 4A is a graphical representation of a draw curve and a release curve for an archery bow, according to some embodiments.
Figure 4B:
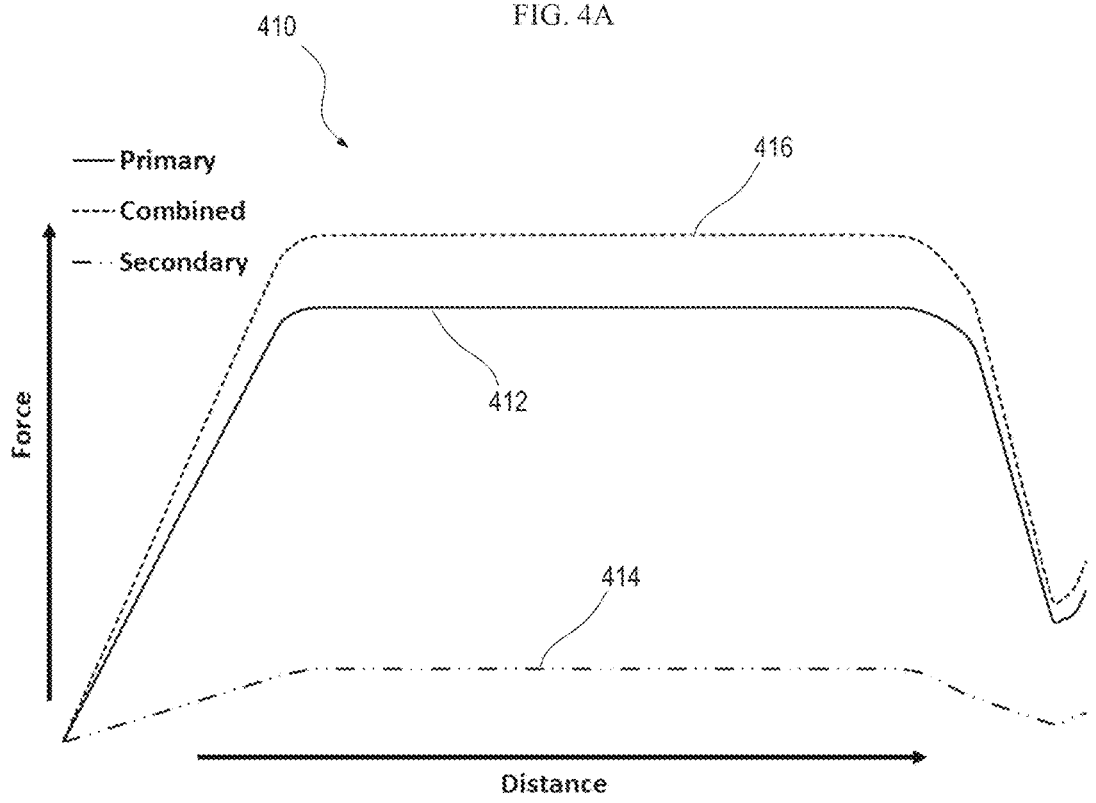
FIG. 4B is a graphical representation of multiple draw curves for an archery bow, according to some embodiments.

A draw force curve can be generated that illustrates force an archer is pulling via the bowstring over a draw distance length of the archery bow (see FIGS. 4A-4B). In some examples, the member can be configured such that the energy releasable via the member can be stored or attained over the entirety of the draw length (i.e., draw distance at fully drawn state). In other words, the member can continuously rotate and deform, bend, compress, or flex an energy storage device as the archer pulls the bowstring to a fully drawn position (draw length). In some examples, the member can be configured such that the additional energy releasable via the member can be applied or felt by the archer over the first half or first third of the draw length. In some examples, the member can be configured such that the additional energy releasable via the member can be applied or felt by the archer over the latter half or latter third of the draw length. In other words, the member can be configured to rotate and deform, bend, compress, or flex an energy storage device during particular segments or regions of the draw length.

In some examples, the member can be coupled to an energy storage device that assists the archer in drawing the archery bow. For example, the archery bow can have a primary energy storage device and a secondary energy storage device. The primary energy storage device (e.g., limbs) can transfer energy to launch a projectile (e.g., arrow). The secondary energy storage device (e.g., a coil spring, a flexible beam, etc.) can be configured to apply a force to the primary storage device that assists the archer in bending or deflecting the primary storage device (i.e., overcoming the draw weight associated with drawing the bow to a fully drawn state). When the bow is in a fully drawn state, the member can actuate such that the secondary storage device no longer applies the force assisting the archer by bending or deflecting the primary storage device. Thus, the primary energy storage device is no longer inhibited and is now capable of transferring a maximum amount of energy to the projectile upon launch.

In some examples, one or more members can be rotatably coupled to one or more limbs of the archery bow. For example, a first member can be rotatably affixed to one or more upper limbs of the archery bow and additionally, or alternatively, one or more members can be rotatably affixed to one or more lower limbs of the archery bow. In some examples, one or more respective cams can be rotatably affixed to the upper and lower limbs and the one or more members can be coupled to one or more of the respective cams. For example, a first cam can be affixed to the upper limbs and a first member can be coupled to the first cam by one or more cables (e.g., a bowstring and/or other cable). Additionally, or alternatively, a second cam can be affixed to the lower limbs and a second member can be coupled to the second cam by one or more cables (e.g., a bowstring and/or other cable).

Additionally, or alternatively, one or more members can be rotatably coupled to other components of the archery bow, such as, a roller guard mount, the riser, a limb pocket, a combination thereof, or another component of the archery bow. For example, one or more members can be rotatably affixed to a roller guard mount or other support structure extending from the riser. The energy storage device coupled to the one or more members can be one or more limbs, springs, elastically deformable elements, a combination thereof, or any other mechanism coupled to the archery bow that can be deformed or otherwise manipulated by the member, directly or indirectly, to releasably store energy for launching a projectile. In some examples, the energy storage device can include one or both of the upper and the lower limbs. In some examples, the energy storage device may not include one or both of the upper and the lower limbs. Instead, the energy storage device can be one or more limbs, springs, elastically deformable elements, or other components that are independent from the upper and the lower limbs.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, features described with respect to certain embodiments may be combined in other embodiments.

Figure 1B:
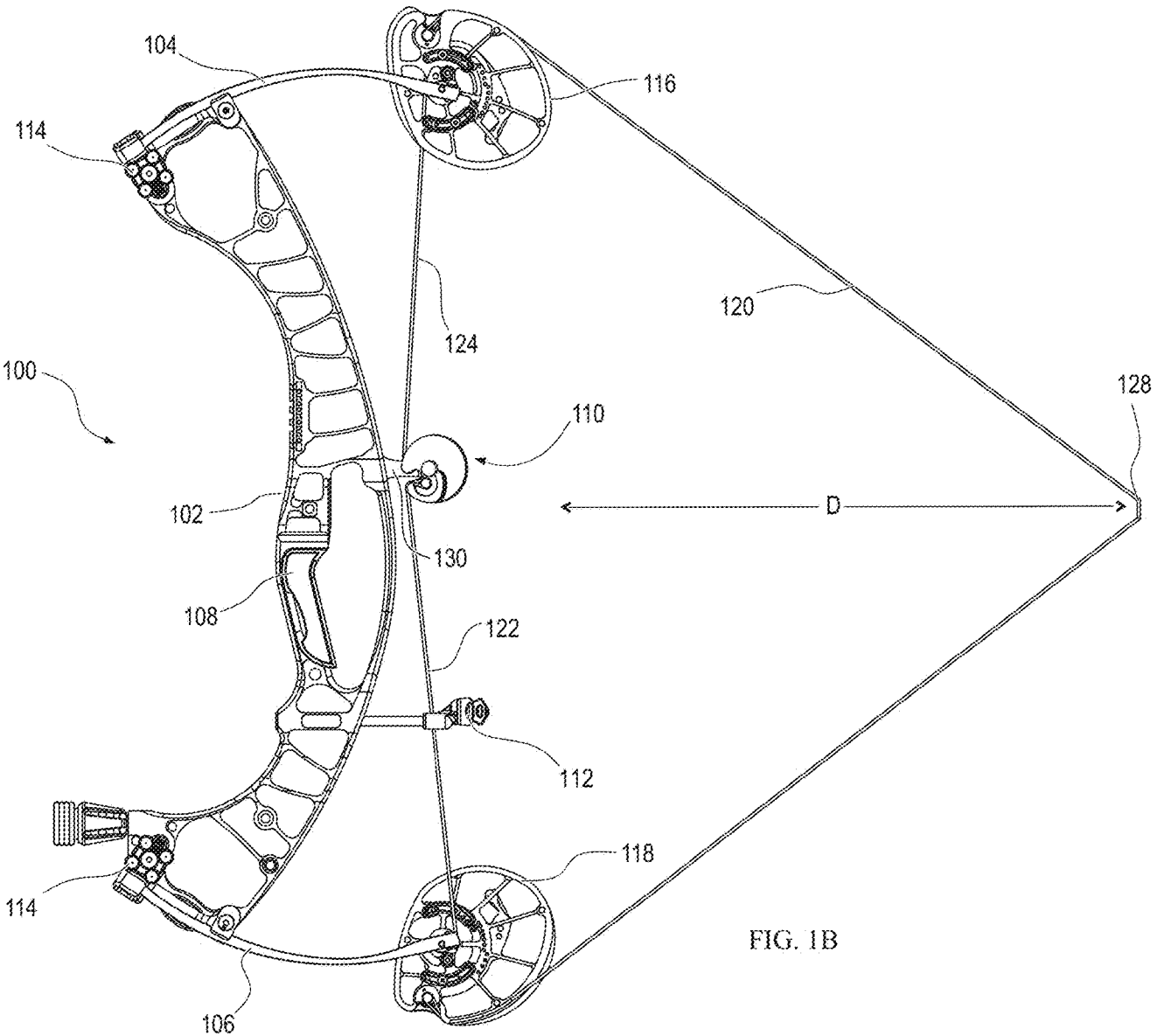
FIG. 1B is a side view of the archery bow in a drawn state.
Figure 1C:
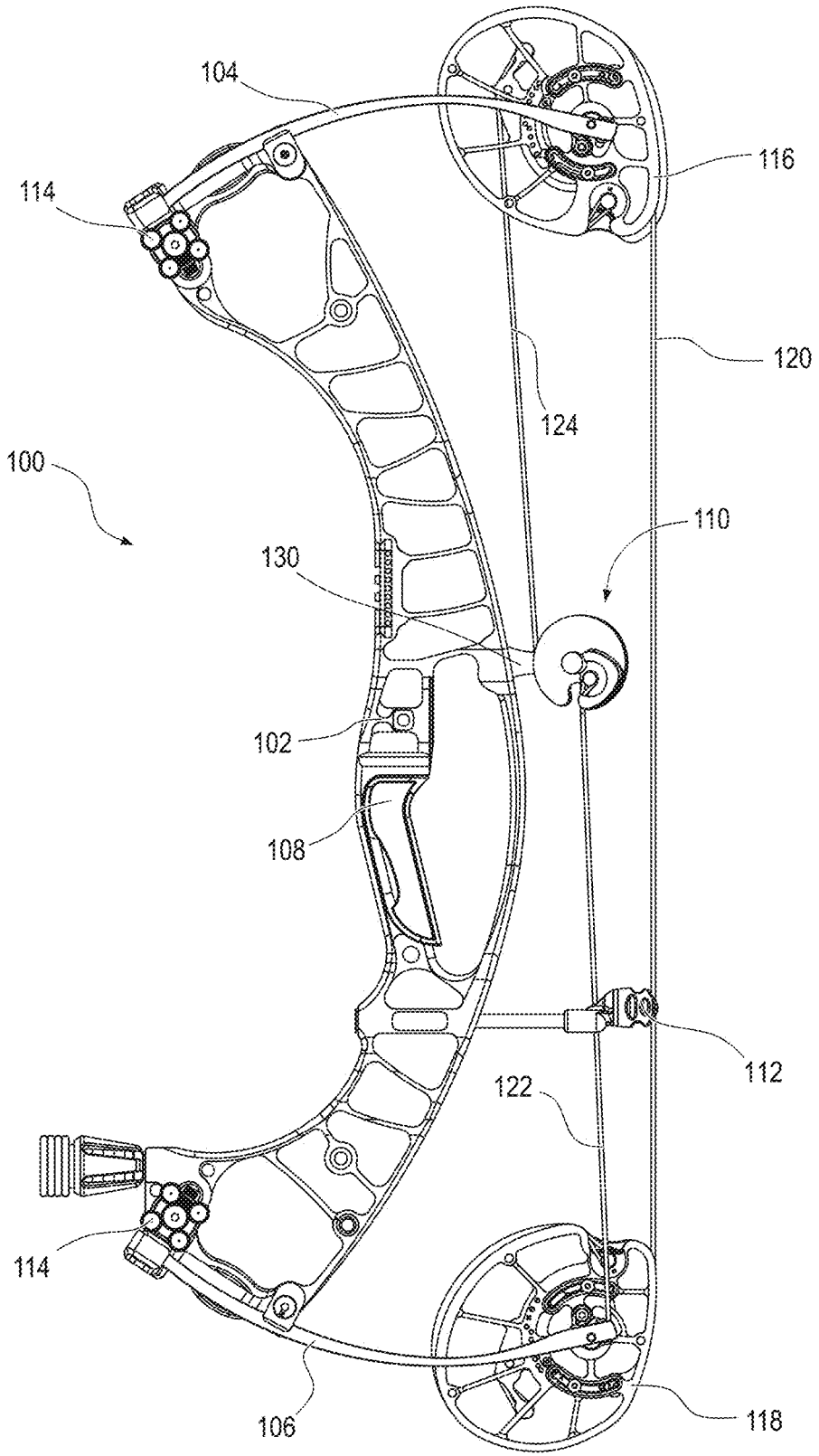
FIG. 1C is a side view of the archery bow in a brace state.
Figure 1D:
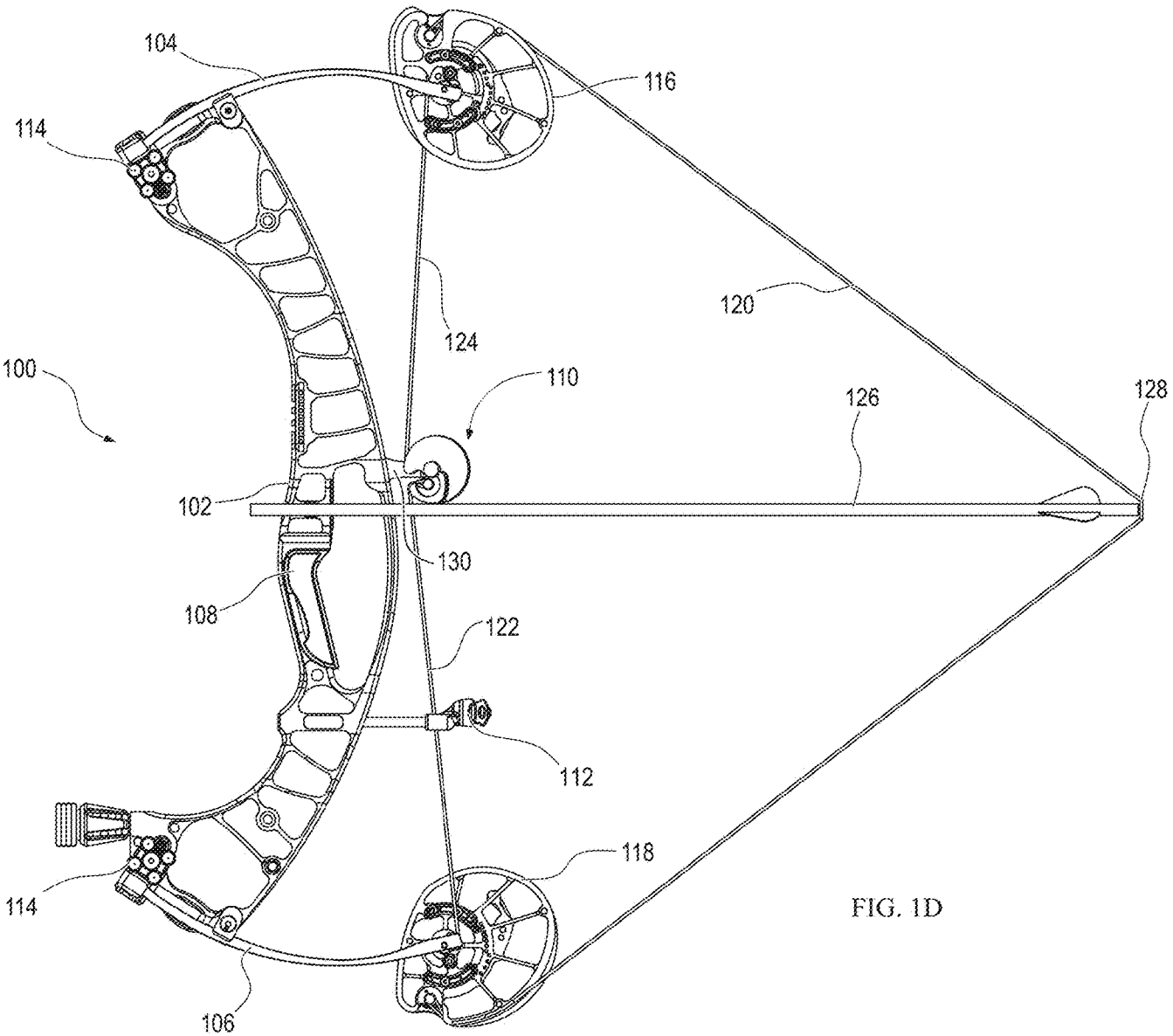
FIG. 1D is a side view of the archery bow in a drawn state.

Referring now to the figures in detail, FIGS. 1A-1D show a compound archery bow 100. The bow 100 is at a rest position (e.g., a brace state or brace position) in FIG. 1A. The bow 100 can comprise a riser 102 from which one or more upper limbs 104 and one or more lower limbs 106 extend. The bow 100 can include a grip 108, a member 110, a string-stop damper 112, and dampers 114. FIG. 1A shows the member 110 in a first orientation or first configuration. FIG. 1C shows the member 110 in a second orientation or second configuration. FIG. 1D shows the member in a third orientation or third configuration. While the archery bow 100 is illustrated as a compound bow, aspects of the present disclosure are equally applicable to other types of bows (e.g., crossbows).

The upper limbs 104 may be connected to an upper cam assembly 116, and the lower limbs 106 may be connected to a lower cam assembly 118. A bowstring 120 (i.e., draw string) may extend across the length of the bow 100 between the upper cam assembly 116 and the lower cam assembly 118 when the bow 100 is positioned vertically upright in a normal shooting orientation. The terminal ends of the bowstring 120 may be attached to and held entrained to the cam assemblies 116, 118, at least in the brace position, and the limbs 104, 106 may be flexed to store energy and retain tension in the bowstring 120. A first cable 122 and a second cable 124 may be attached to and extend respectively between the upper cam assembly 116 and the lower cam assembly 118 and the member 110. For example, the first cable 122 can extend from the lower cam assembly 118 to the member 110 and the second cable 124 can extend from the upper cam assembly 116 to the member 110. Collectively, the first cable 122 and the second cable 124 may be referred to herein as the cables of the bow 100. The first and second cables 122, 124 may retain tension in the limbs 104, 106 and cam assemblies 116, 118 and may be controlled to adjust tension in the bowstring 120, draw length of the bowstring 120, and other tuning features of the bow 100. In some examples, the upper cam assembly 116 and the lower cam assembly 118 can be directly coupled to the riser 102, such as, a crossbow platform having cam assemblies rotatably coupled to the riser instead of respective limbs.

In some examples, the member 110 can releasably lock the limbs 104, 106 and/or another energy storage device in a flexed, bent, compressed, or tensioned state to releasably store potential/stored energy when the archer pulls or draws the bowstring 120 a predetermined distance from the brace position (e.g., pulls the bowstring 120 some distance between the brace position shown in FIG. 1A and a fully drawn position shown in FIG. 1D). FIG. 1B illustrates the bowstring 120 drawn a distance D from a position of the bowstring 120 at the brace position. The distance D that the bowstring 120 is pulled or drawn can be sufficient to rotate the member 110 into an energy-locked state. While FIG. 1B depicts the distance D as fully drawn or near-fully drawn, the distance D can be less than fully drawn or near-fully drawn, such as, a quarter, a half, or three quarters of the fully drawn position. For example, the distance D can be less than about 5 centimeters (cm), between about 5 cm and about 15 cm, between about 15 cm and about 25 cm, between about 25 cm and about 35 cm, between about 35 cm and about 45 cm, between about 45 cm and about 55 cm, between about 55 cm and about 65 cm, between about 65 cm and about 75 cm, or greater than about 75 cm.

After the member 110 releasably locks the limbs 104, 106 or other energy storage device in a flexed, bent, compressed, or tensioned state, the archer can let the bowstring 120 down and the potential/stored energy can be releasably retained by the member 110 (shown in FIG. 1C). For example, the member 110 can remain in an orientation which does not permit the limbs 106, 108 to unflex or return to the initial position of the limbs 104, 106 at the brace position (see FIG. 1A). Thus, the member 110 can retain respective distal ends of one or more of the limbs 104, 106 in a partially flexed state.

In some examples, the distal ends of the limbs 104, 106 are displaced as the member 110 rotates from the first orientation to the second orientation and remain displaced while the member 110 is in the second orientation. Additionally, or alternatively, the member 110 can remain in an orientation which flexes, bends, or otherwise deforms a secondary energy source (e.g., a secondary set of limbs, coiled springs, or other energy storage mechanism not shown in FIGS. 1A-1D). For example, the archery bow 100 can further include a secondary set of limbs (not shown) coupled to the riser 102 and configured to flex or bend as a result of rotation of the member 110. The secondary set of limbs can contact the limbs 104, 106 while the archery bow 100 is in a fully drawn state and apply a force on the limbs 104, 106 while the archery bow 100 transitions from the fully drawn state to the brace state.

In some examples, retaining one or more of the limbs 104, 106 in a partially flexed state can cause a tension in the bowstring 120 to decrease. In other words, tension in the bowstring 120 can decrease while the member 110 is in the second orientation or second configuration (see FIG. 1C). In some examples, the archery bow 100 can include a mechanism (not shown) configured to tension the bowstring 120 while the member 110 is in an energy-locked state (e.g., in the second orientation shown in FIG. 1C). Additionally, or alternatively, the tension in the bowstring 120 in a brace position (see FIG. 1A) can be relatively high such that the tension in the bowstring 120 while the member 110 is in an energy-locked state (see FIG. 1C) remains high enough to ensure the bowstring 120 is retained within respective string tracks formed by the upper and lower cam assemblies 116, 118. Additionally, or alternatively, the bow 100 can include one or more cables (e.g., first and second cables 122, 124) that extend through one or more roller wheels, such as, a roller guard assembly. In some examples, the one or more roller wheels can be slidable or repositionable to apply a tensioning force on one or more of the cables.

When the archer is ready to launch the arrow 126 down range, the archer can draw the bowstring 120 to the fully drawn position (shown in FIG. 1D) without having to pull draw weight associated or correlated with the potential/stored energy releasably retained by the member 110. A combination of the potential/stored energy releasably locked by the member 110 and a potential energy associated with drawing the bow 100 to a fully drawn state can be applied to the arrow 126 when the archer releases the bowstring 120. Accordingly, among other benefits, aspects of the present disclosure relate to utilizing additional potential energy through multiple draws of the bowstring 120 to increase projectile speed and other performance characteristics of the bow 100. In examples, some aspects of the present disclosure relate to mechanisms and methods utilizing a secondary potential energy (e.g., a secondary energy storing mechanism other than the limbs 104, 106) combined with the primary potential energy (i.e., energy generated by drawing the bowstring 120 to a fully drawn position) to increase performance characteristics of the bow 100.

While FIGS. 1A-1D show the archery bow 100 having a singular member 110, other examples of the archery bow 100 can have more than one member 110. For example, the archery bow can include a second member and respective cables extending from the second member to the upper and lower cam assemblies 116, 118. In some examples, the member 110 and second member (not shown) can simultaneously rotate to the second orientation to flex or bend the upper and lower limbs 104,106 to a flexed or bent state. In some examples, the member 110 and the second member can rotate in opposite directions. In some examples, the member 110 and the second member can rotate about the same axis of rotation (i.e., a shared axis of rotation). In some examples, the member 110 and the second member can rotate about different axes of rotation. For example, the second member can rotate about an axis of rotation that is parallel to and offset from an axis of rotation of the member 110. In some examples, a single member 110 can be used for multiple sets of cables 122, 124.

Figure 1E:
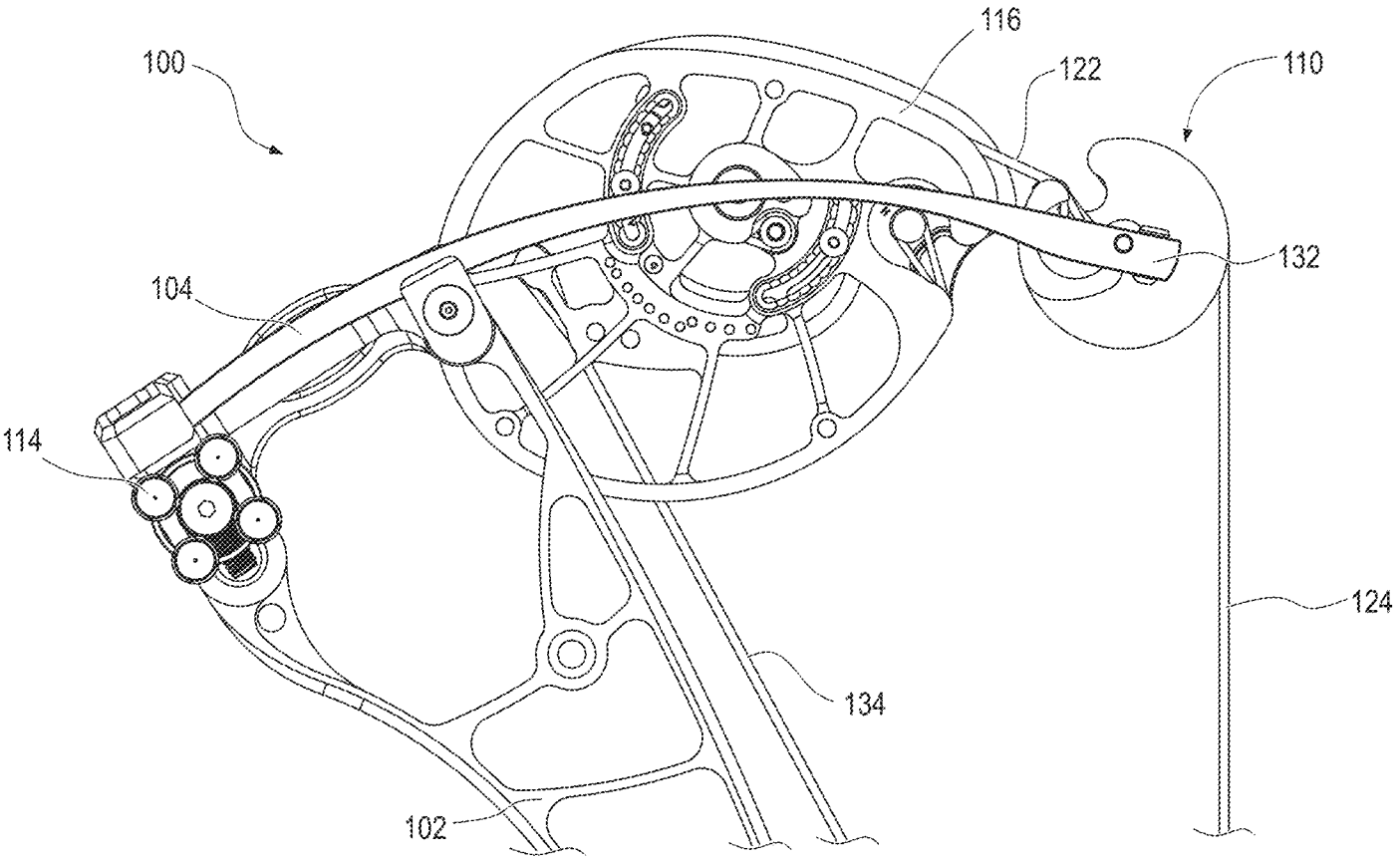
FIG. 1E is a detail view of an archery bow, according to some embodiments.
Figure 1F:
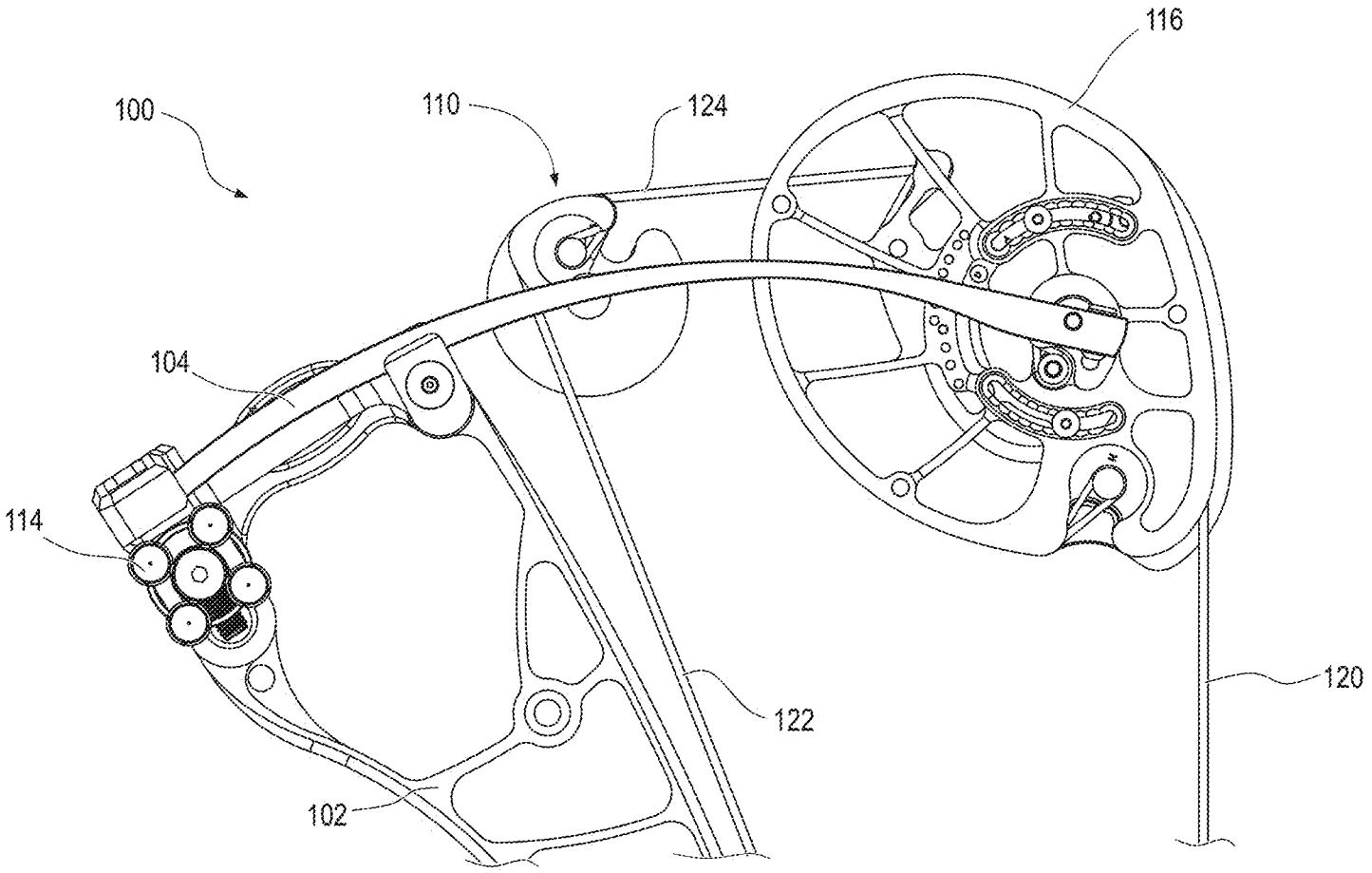
FIG. 1F is a detail view of an archery bow, according to some embodiments.

While the member 110 is depicted in FIGS. 1A-1D as coupled to the riser 102 at a particular location via a bracket 130, one or more members 110 can be coupled, fastened, or otherwise affixed to any component of the bow 100. For example, one or more members 110 can be affixed to the upper limbs 104, the lower limbs 106, the riser 102, the upper cam assembly 116, the lower cam assembly 118, another component of the bow 100, or a combination thereof. FIGS. 1E and 1F show examples wherein the member 110 is alternatively, or additionally, affixed to the upper limb 104.

FIG. 1E shows the member 110 rotatably coupled to the upper limbs 104 at a distal end 132 of the upper limbs 104. In this example, the second cable 124 can act as the bowstring which is drawn and released by the archer to launch a projectile from the bow 100. When an archer pulls or draws the second cable 124, the second cable 124 can induce the member 110 to rotate. The first cable 122 can extend between the member 110 and the upper cam assembly 116 and induce a force on the upper cam assembly 116 when the member 110 is rotated. A third cable 134 can extend from the upper cam assembly 116, for example, from the upper cam assembly 116 to the lower cam assembly 118. The member 110 can be rotatably coupled to the upper limbs 104 by one or more axles, fasteners, limb-hangers, bearing surfaces, a combination thereof, or any other mechanism or feature for rotatably coupling the member 110 to the upper limbs 104.

FIG. 1F shows the member 110 rotatably coupled to the upper limbs 104 between the upper cam assembly 116 and the riser 102. The first cable 122 can extend from the member 110 to another component of the archery bow 100, for example, to the lower cam assembly 118 and/or a second member coupled to the lower limbs 106. The second cable 124 can extend between the member 110 and the upper cam assembly 116. The member 110 can be rotatably coupled to the upper limbs 104 by one or more axles, fasteners, limb-hangers, bearing surfaces, a combination thereof, or any other mechanism or feature for rotatably coupling the member 110 to the upper limbs 104. While FIGS. 1E and 1F show the member 110 rotatably coupled to the upper limbs 104, the member 110 can be rotatably coupled to the lower limbs 106 in other examples. In some examples, respective members can be rotatably coupled to each of the lower limbs 106 and the upper limbs 104.

In some examples, a first member can be rotatably coupled to the upper limbs 104 and a second member can be rotatably coupled to the lower limbs 106. For example, the first member can be rotatably coupled to the upper limb 104 between the upper cam assembly 116 and the riser 102. Similarly, the second member can be rotatably coupled to the lower limb 106 between the lower cam assembly 118 and the riser 102. Alternatively, the first member can be rotatably coupled to the upper limbs 104 at a distal end of the upper limbs 104 and the second member can be rotatably coupled to the lower limbs 106 at a distal end of the lower limbs 106.

The figures illustrate example archery apparatuses that may be used in conjunction with the principles and teachings of the present disclosure. Thus, while the archery bows described herein are compound bows, it will be understood by those having ordinary skill in the art that the components of the archery bow, accessories, such as an arrow rest, and related methods and apparatuses included in embodiments of the present disclosure may be applied to components and apparatuses in compound bows, crossbows, their accessories, such as arrow rests, and other archery related equipment. Similarly, archery equipment applying the teachings of the present disclosure does not need to implement all of the features of the present disclosure. For example, in some embodiments, the bow may not comprise dampers 114 or a string-stop damper 112, so features associated with those accessories may be omitted from the bow.

Figure 2A:
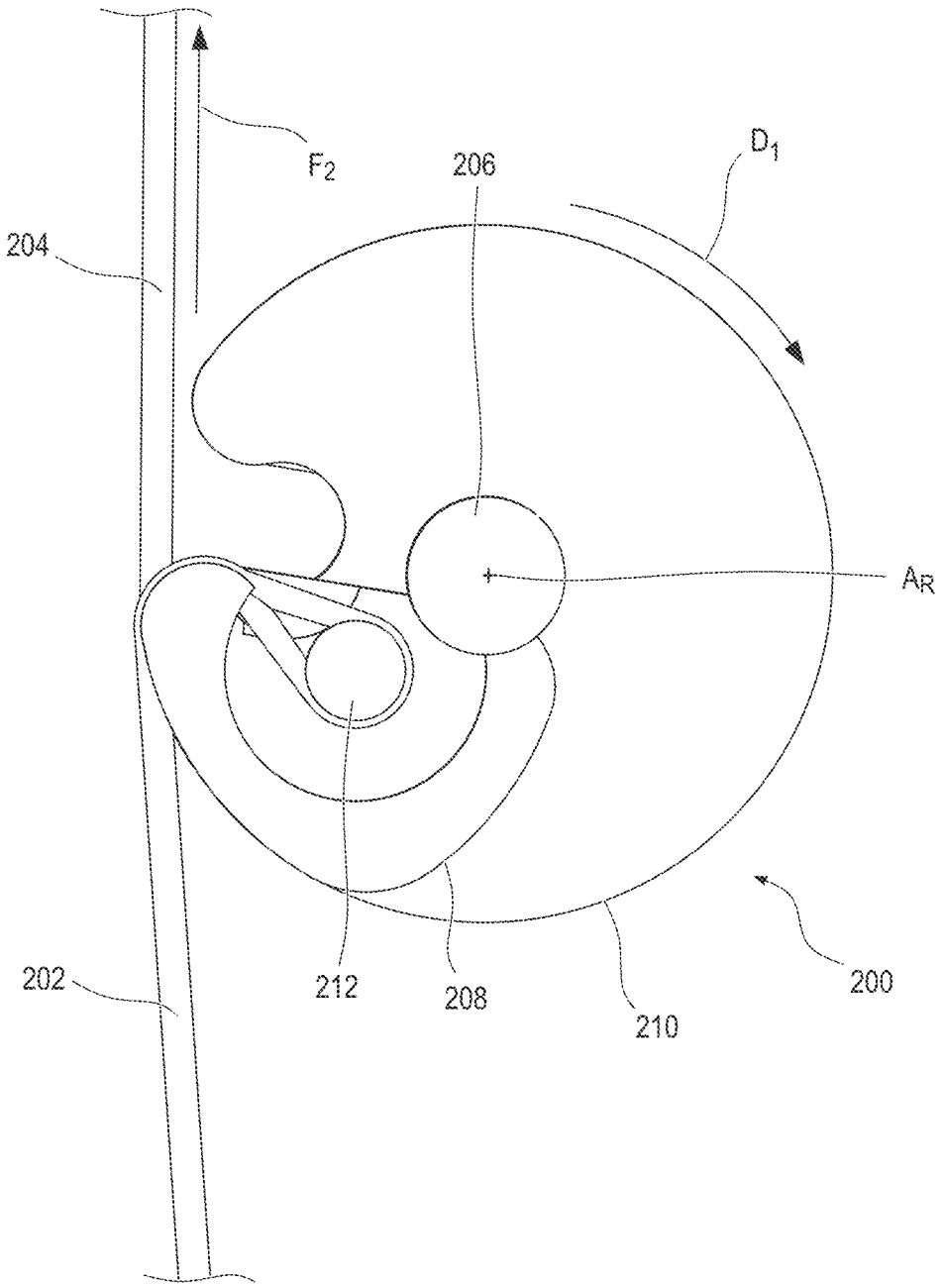
FIG. 2A is a detail view of a rotatable member in a first orientation, according to some embodiments.

FIG. 2A shows a wheel or member 200 in a first orientation. The member 200 can be substantially similar to, and can include some or all of, the features of the member 110. For example, the member 200 can be rotatable from the first orientation to a second orientation (see FIG. 2B) wherein the member 200 is capable of retaining an energy storage device (e.g., one or more limbs, springs, etc.) in a bent, flexed, elongated, compressed, or displaced state. The member 200 can be tethered or coupled to one or more energy storage devices (not shown) by a first cable 202 and a second cable 204. The first and second cables 202, 204 can be entrained within one or more grooves defined by the member 200 such that the first and second cables 202, 204 can be wound and unwound relative to the member 200. In some examples, the member 200 can correlate to an archery bow (bow 100) in a brace state (see FIG. 1A) while in the first orientation. That is, the member 200 can be in an orientation that does not induce additional flex or stress on the energy storage device (s) (i.e., the member 200 is not in an energy-locked state, see FIGS. 2B and 2C).

In some examples, the member 200 can include a first hub 206, a second hub (see FIG. 3B), a first cable track 208, a second cable track 210, a first cable peg (see FIG. 3B), and a second cable peg 212. While the member 200 is depicted independent of the archery bow in FIGS. 2A-2D, the member 200 can be coupled, fastened, or otherwise affixed to any component of an archery bow, such as, one or more limbs, a riser, one or more cam assemblies, a roller guard assembly, a limb pocket, another component of the archery bow, or a combination thereof. The first and second cables 202, 204 can be coupled to the member 200 by the first cable peg and the second cable peg 212, respectively.

In some examples, the member 200 is rotatable about an axis of rotation $A_R$. For example, the first hub 206 and/or the second hub can at least partially define the axis of rotation $A_R$. In some examples, the first hub 206 and/or the second hub can be coupled or retained within a support structure (see FIG. 3A) configured to enable the member 200 to rotate or vary in orientation yet retain the member 200 in a fixed position relative to the archery bow. In some examples, one or more of the first hub 206 and/or the second hub of the member 200 can be rotatably coupled to one or more limbs (e.g., upper limbs 104 or lower limbs 106) of the archery bow.

Rotation of the member 200 in a first direction $D_1$ can cause the second cable 204 to unwind or let out from the second cable track 210 while simultaneously causing the first cable 202 to entrain or wind into the first cable track 208. For example, the second cable 204 can be coupled to a cam assembly that applies a force $F_2$ to the member 200 through the second cable 204 when an archer draws or pulls the bowstring (e.g., bowstring 120). In some examples, rotation of the member 200 in the first direction $D_1$ can cause the energy storage device(s) (not shown) coupled to the first and second cables 202, 204 to flex, bend, or otherwise deform from an initial position or state.

Figure 2B:
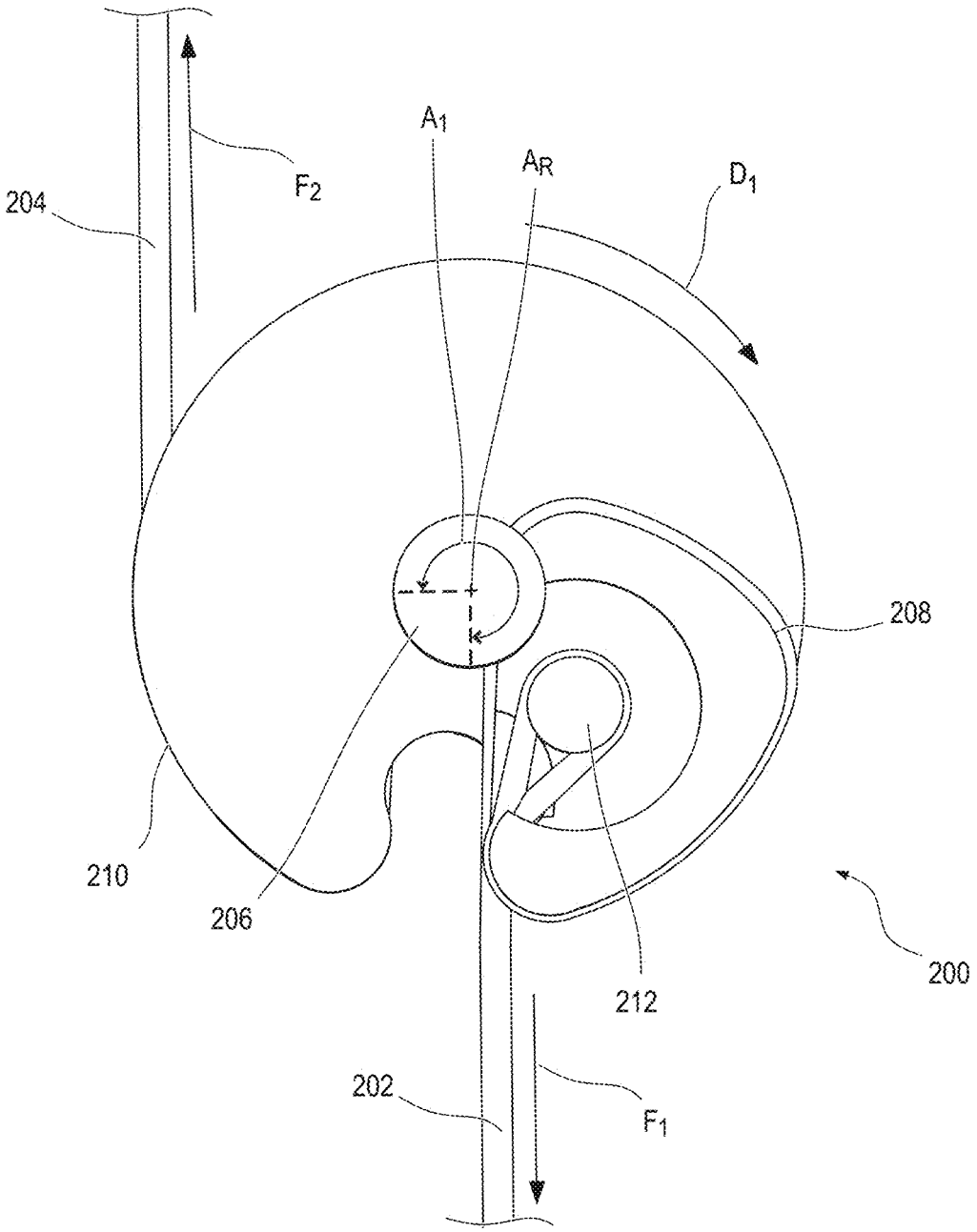
FIG. 2B is a detail view of the rotatable member in a second orientation, according to some embodiments.

As shown in FIG. 2B, the member 200 can rotate in the first direction $D_1$ from the first orientation to the second orientation by an angle $A_1$. As the member 200 rotates into the second orientation, the first cable 202 can entrain or wind relative to the first cable track 208 such that the first cable 202 applies a force $F_1$ that retains the member 200 in the second orientation. For example, while the member 200 rotates from the first orientation (see FIG. 2A) to the second orientation (see FIG. 2B), a portion of the first cable 202 can intersect or substantially intersect the axis of rotation $A_R$ such that the member 200 is biased by the first cable 202 to remain in the second orientation. While the angle $A_1$ is depicted as about 270 degrees in FIG. 2B, the first and second cable tracks 208, 210 can be formed to enable the second orientation to be reached after rotating the member 200 more or less than 270 degrees from the first orientation. For example, the angle $A_1$ can be less than about 90 degrees, between about 90 degrees and about 180 degrees, between about 180 degrees and about 270 degrees, or greater than 270 degrees.

Figure 2C:
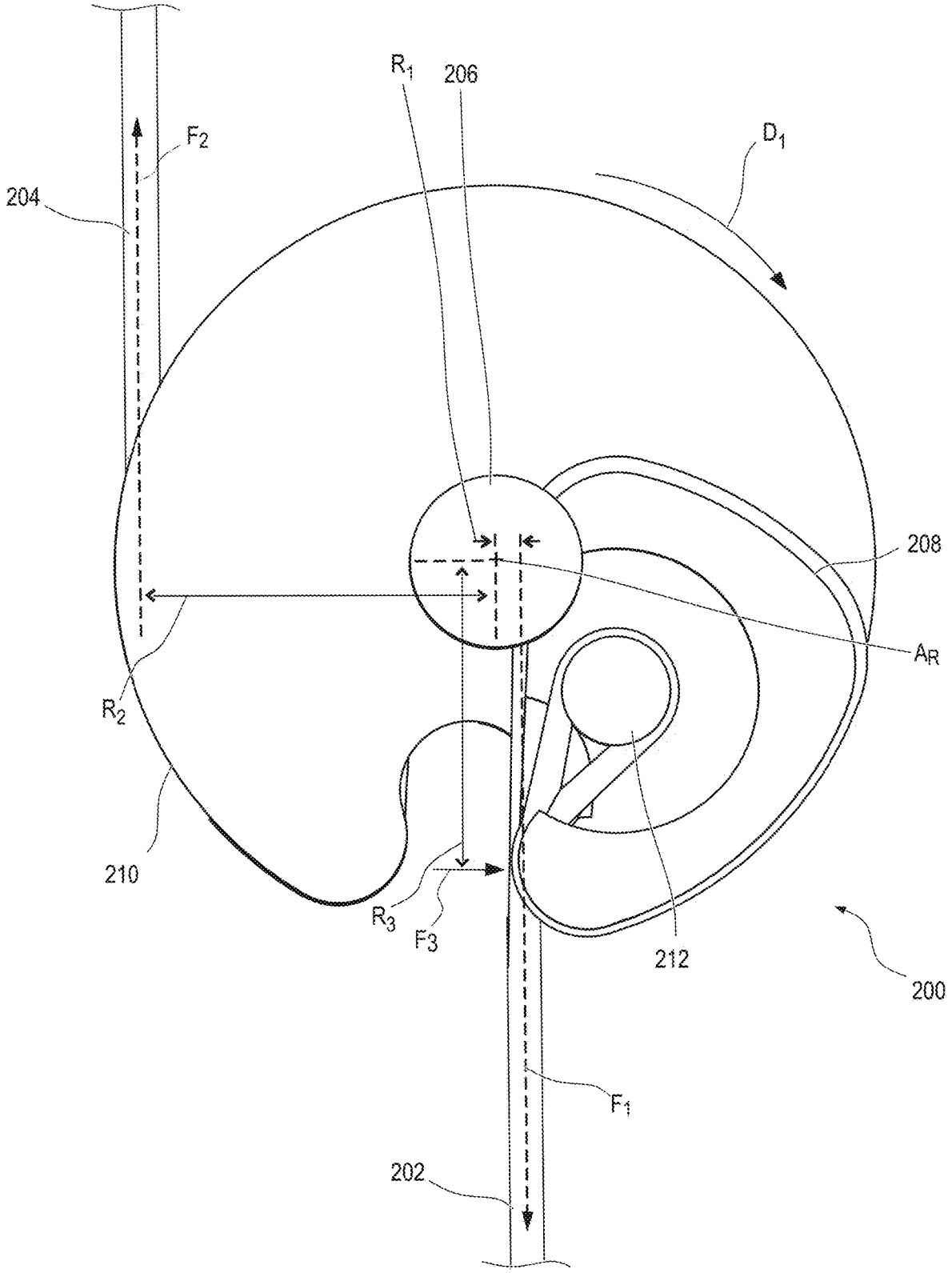
FIG. 2C is a detail view of the rotatable member in the second orientation, according to some embodiments.

FIG. 2C also shows the member 200 in the second orientation (e.g., an energy-locked state). In some examples, the force $F_2$ and a radius $R_2$ that the force $F_2$ is applied to the member 200 from the axis of rotation $A_R$ can form a lever arm inducing a torque or moment on the member 200. The force $F_1$ and a radius $R_1$ that the force $F_1$ is applied to the member 200 from the axis of rotation $A_R$ can form a lever arm inducing an additional torque or moment on the member 200. A force $F_3$ can be applied to the member 200 at a radius $R_3$ from the axis of rotation $A_R$ by the first cable 202 to induce an additional torque or moment on the member 200. In some examples, while the member 200 is in the second orientation, the radius $R_2$ can be about 0 millimeters (mm), between about 0 mm and about 3 mm, between about 3 mm and about 6 mm, between about 6 mm and about 9 mm, between about 9 mm and about 12 mm, between about 12 mm and about 15 mm, or greater than 15 mm. The overall torque induced on the member 200 while the member 200 is in the second orientation can sum to zero or substantially zero, as shown in Equation 1 below.

$$0=F_1*R_1+F_2*R_2-F_3*R_3 \quad \text{EQUATION 1}$$

In some examples, the first cable 202 can be elastically deformable to provide at least a portion of the force $F_1$. For example, the first cable 202 can stretch or elongate as the member 200 rotates in the first direction $D_1$ and apply a biasing force (e.g., force $F_1$) due to the elastic or plastic deformation of the first cable 202. In some examples, the first cable 202 can be a first length while the member 200 is in the first orientation and elastically deform to a second length while the member 200 is in the second orientation.

Figure 2D:
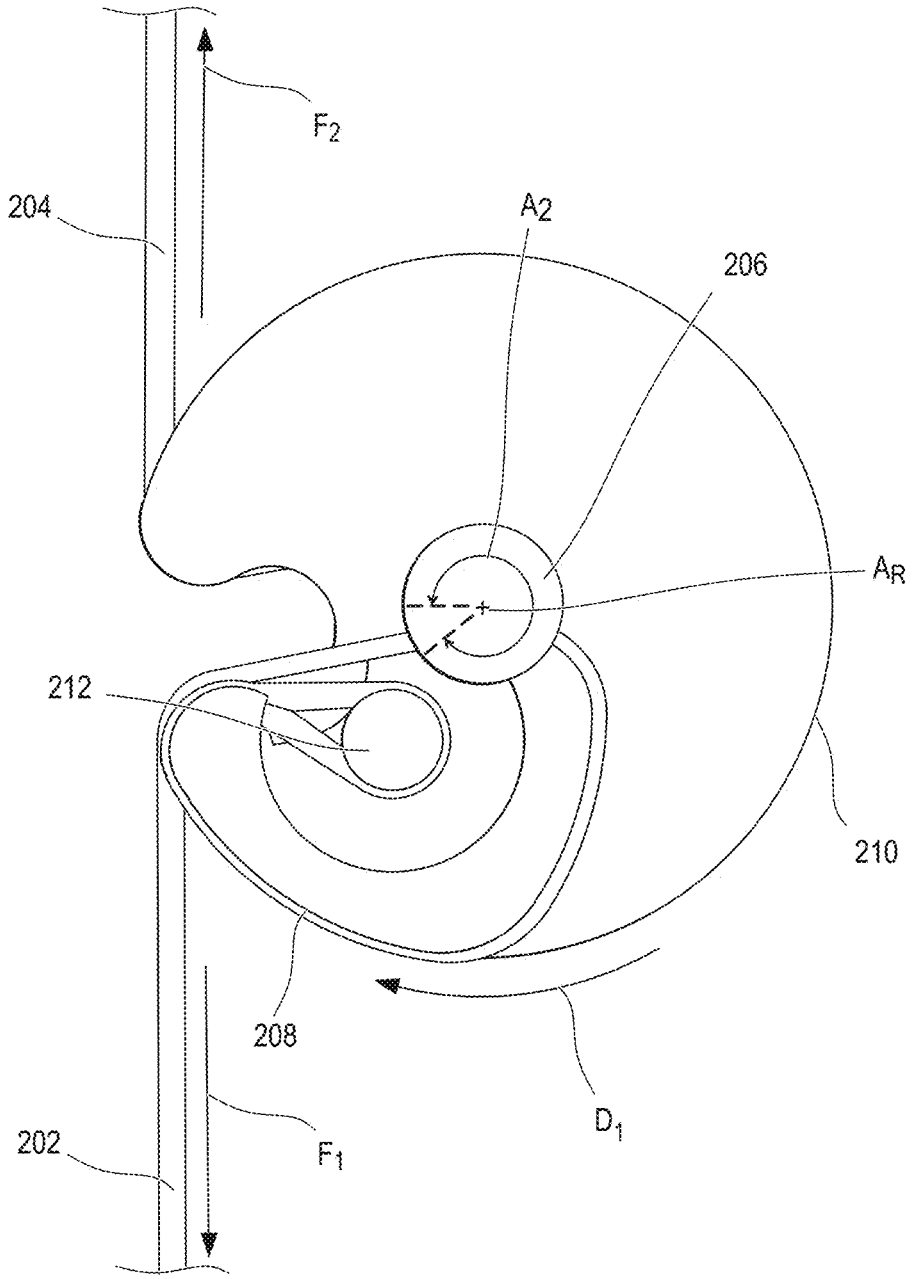
FIG. 2D is a detail view of the rotatable member in a third orientation, according to some embodiments.

FIG. 2D shows the member 200 in a third orientation wherein the member 200 is rotated in the first direction $D_1$ beyond the second orientation (see FIGS. 2B and 2C). In some examples, the archer can pull the bowstring (e.g., bowstring 120) to rotate the upper and lower cam assemblies (e.g., upper and lower cam assemblies 116, 118) and cause the first and second cables 202, 204 to apply the force $F_1$ and the force F2 at sufficiently high magnitudes to overcome the force $F_3$ and cause the member 200 to rotate in the first direction $D_1$ to the third orientation. The third orientation can be displaced from the first orientation by an angle $A_2$. While the angle $A_2$ is depicted as about 315 degrees in FIG. 2D, the first and second cable tracks 208, 210 can be formed to enable the third orientation to be reached after rotating the member 200 more or less than 315 degrees from the first orientation. For example, the angle $A_2$ can be less than about 90 degrees, between about 90 degrees and about 180 degrees, between about 180 degrees and about 270 degrees, between about 270 degrees and about 315 degrees, or greater than 315 degrees.

In some examples, the member 200 can rotate from the second orientation to the third orientation when the force $F_3$ is less than the sum of the lever arms associated with the forces $F_1$, $F_2$ divided by the radius $R_3$. This correlation is represented as Equation 2 below.

$$F_3 < \frac{F_1*R_1+F_2*R_2}{R_3} \quad \text{EQUATION 2}$$

In some examples, the member 200 can function as an actuator for transferring energy into a projectile launched from the archery bow without requiring a trigger, button, lever, or other mechanism that must receive direct input from the archer to actuate. The member 200 can automatically transfer potential energy from an energy storage device into a projectile when a momentum of the member 200, such as an angular momentum of the member 200 generated as the member 200 rotates from the third orientation to the second orientation, meets or exceeds a threshold momentum (i.e., momentum greater than the biasing torque retaining the member 200 in the second orientation). In some examples, momentum sufficient to meet or exceed the momentum threshold can be attained when the archery bow is drawn to the fully drawn state and the bowstring is released by the archer.

Figure 2E:
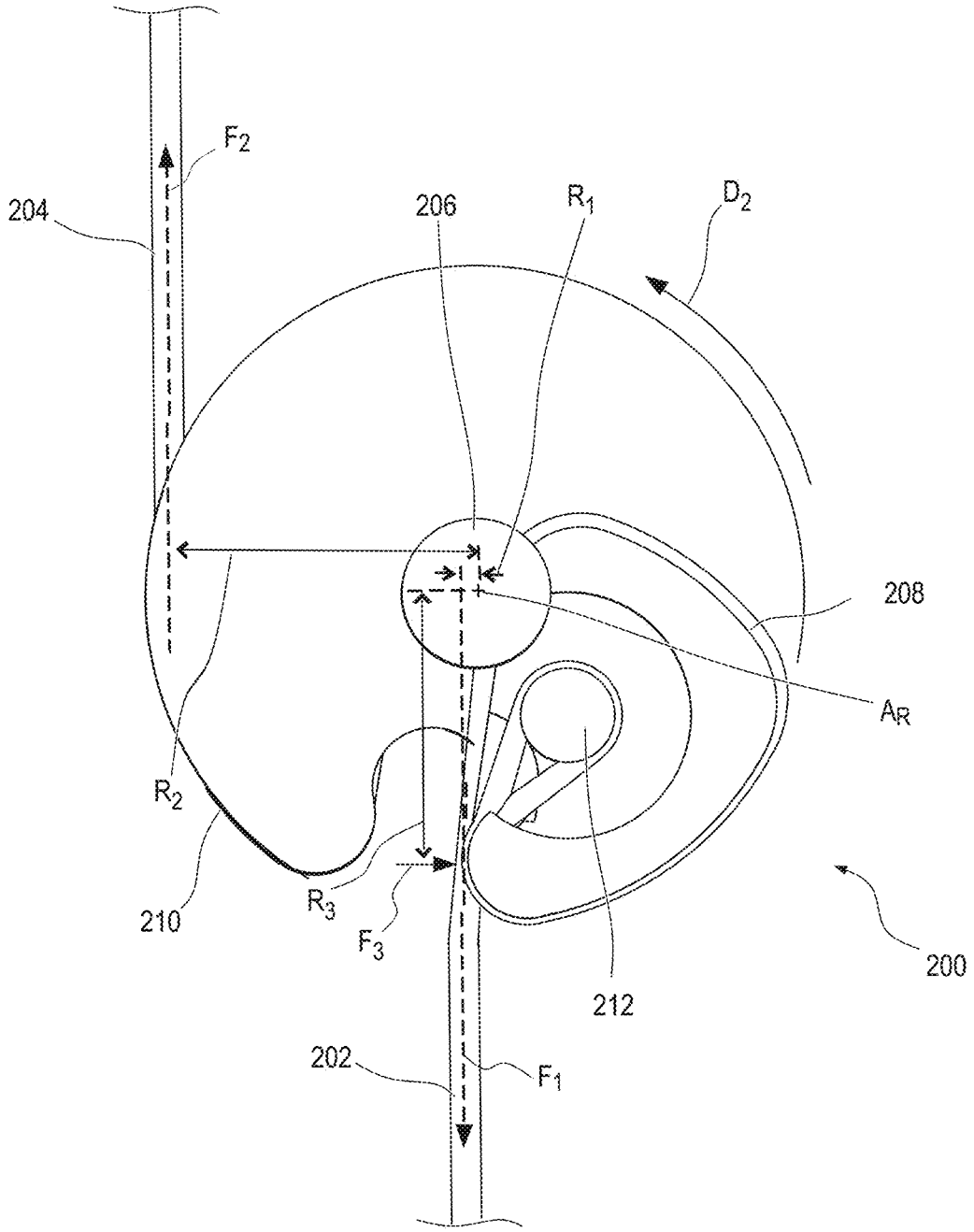
FIG. 2E is a detail view of the rotatable member transitioning from the third orientation to the first orientation, according to some embodiments.

As shown in FIG. 2E, releasing the bowstring can enable the member 200 to rotate in a second direction $D_2$ (e.g., opposite the first direction $D_1$) at an angular velocity sufficient to generate a momentum that meets or exceeds the momentum threshold. When the momentum threshold is exceeded or met, the potential energy locked by the member 200 can be released into the projectile as the member 200 rotates from the third orientation, past the second orientation, to the first orientation. As the member 200 rotates from the third orientation to the second orientation with sufficient momentum, the radius $R_2$ can transition from one side of the axis of rotation $A_R$ to the other side of the axis of rotation $A_R$ and cause the lever arm associated with the force $F_1$ to apply a moment or torque biasing the member 200 to rotate in the second direction $D_2$. In other words, when the radius $R_2$ transitions from one side of the axis of rotation $A_R$ to the other side of the axis of rotation $A_R$, the force $F_1$ no longer biases the member 200 to remain in the second orientation but causes the member 200 to rotate to the first orientation.

In some examples, the member 200 can automatically return to the second configuration (i.e., a configuration that does not release the potential energy) if the archer slowly lets the bowstring down such that the angular velocity of the member 200 does not generate sufficient momentum to meet or exceed the threshold momentum (i.e., when the bowstring is drawn and let down relatively slowly by the archer). In this use case, the momentum of the member 200 is not sufficient to overcome the lever arm associated with the force $F_1$ and the radius $R_1$.

The potential/stored energy can be transferred to the projectile (e.g., arrow 126) when the archer wishes to launch the projectile, yet the potential/stored energy can be saved or preserved for a subsequent shot if the archer lets the bowstring down and returns the bow to a brace state. Both of these use cases can be achieved without requiring the archer to apply a direct input to a trigger, lever, or button. Instead, a momentum of the member 200 can automatically transfer or preserve the potential/stored energy based on the archer's normal use of the archery bow.

Figure 3A:
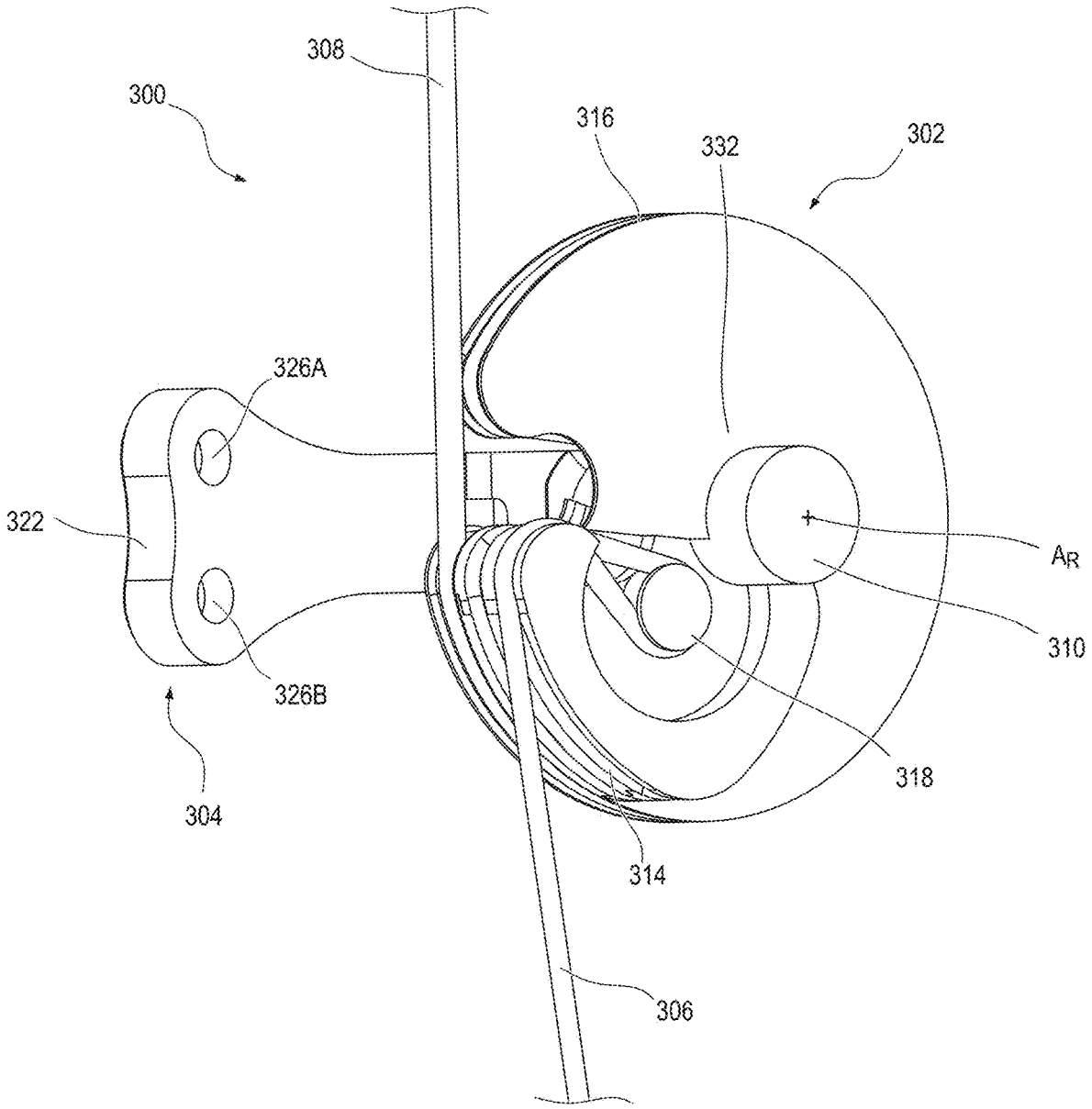
FIG. 3A is a detail perspective side view of an assembly in a first configuration, according to some embodiments.
Figure 3B:
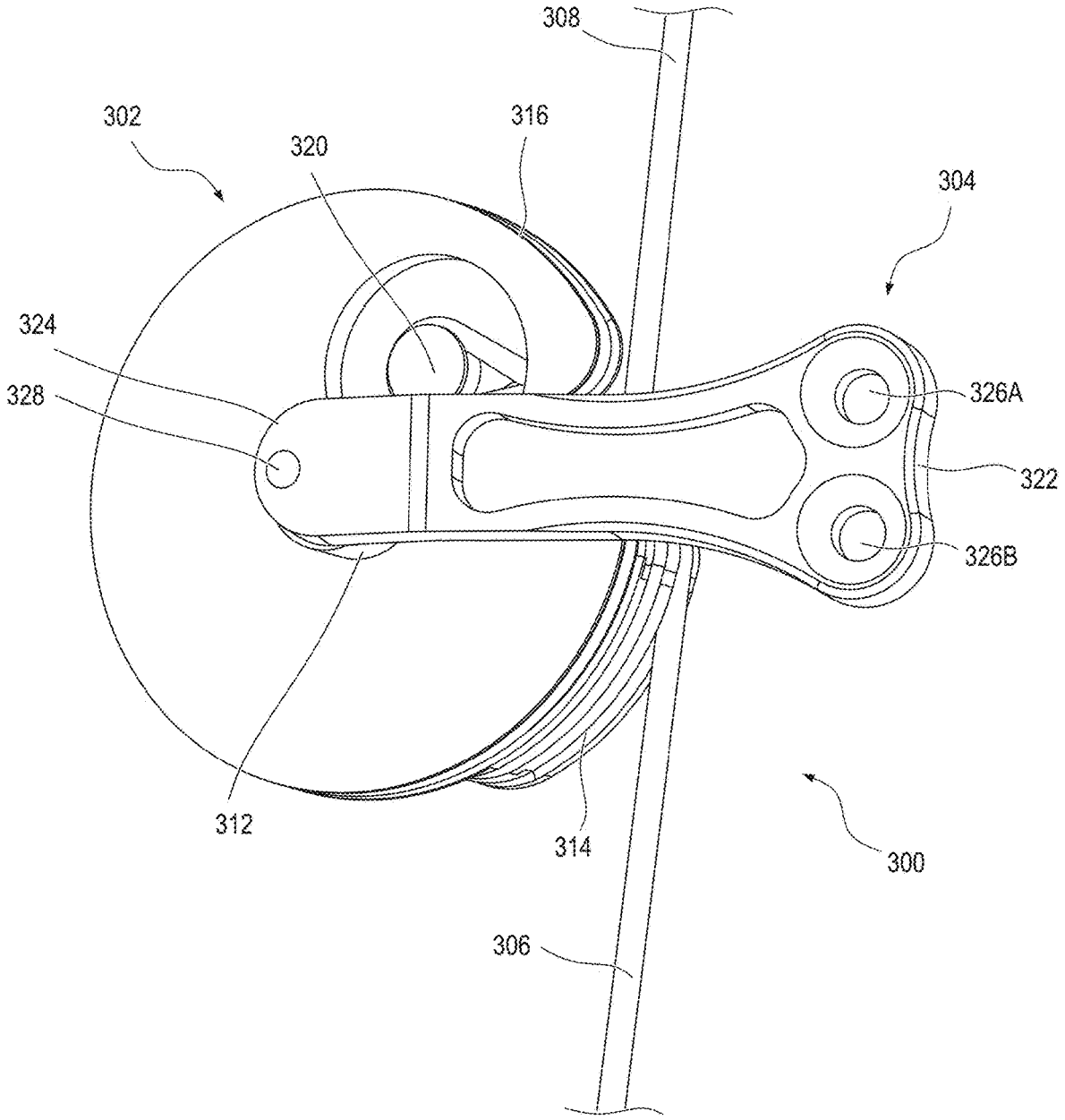
FIG. 3B is a detail perspective side view of the assembly in the first configuration, according to some embodiments.
Figure 3C:
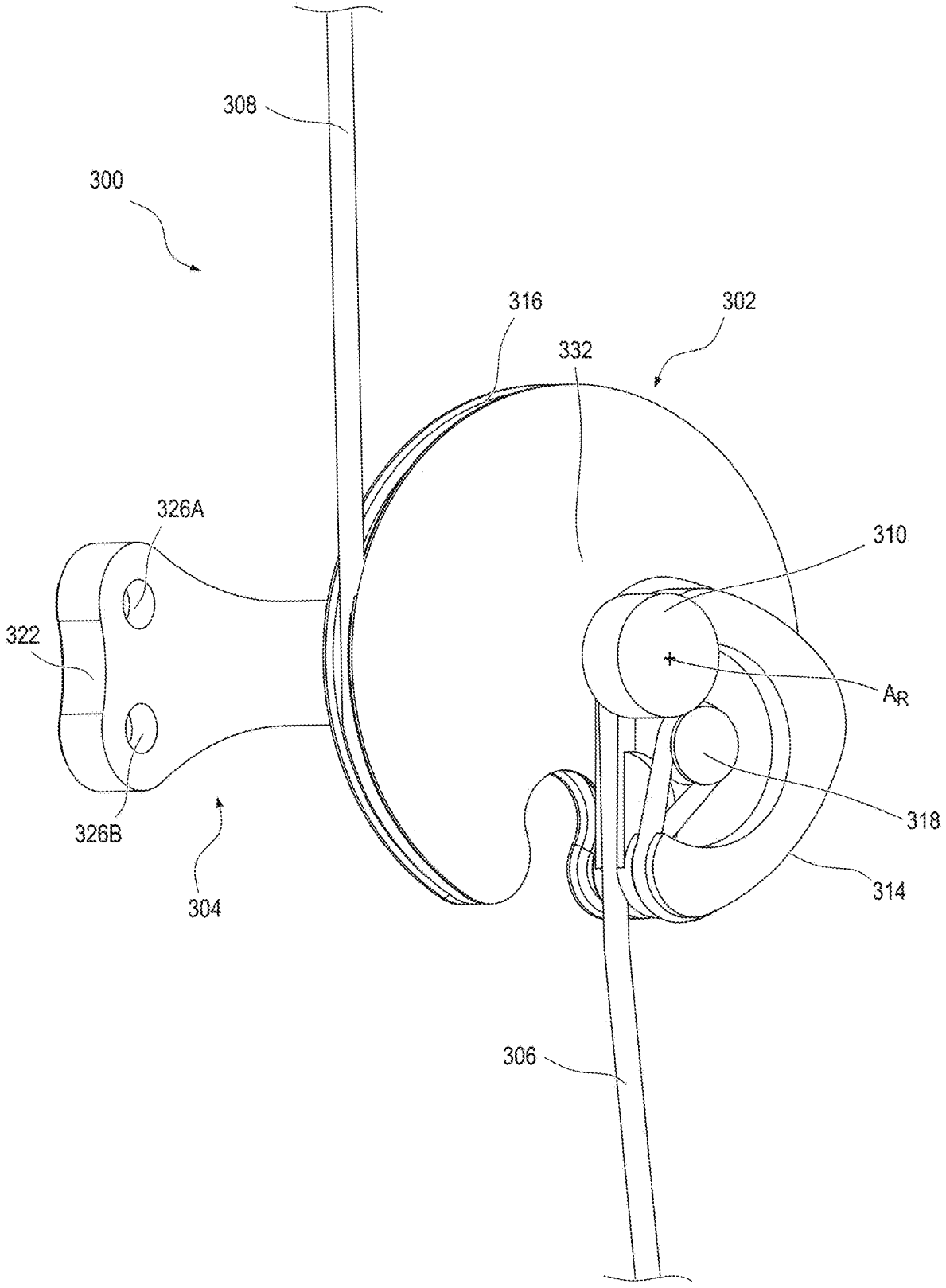
FIG. 3C is a detail perspective side view of the assembly in a second configuration, according to some embodiments.

FIGS. 3A and 3B show an assembly 300 including a wheel or member 302, a bracket or support structure 304, a first cable 306, and a second cable 308. The assembly 300 can be in a first configuration wherein the member 302 is not in an energy-locked state. The member 302 can be tethered or coupled to one or more energy storage devices (not shown) by the first cable 306 and the second cable 308. The first and second cables 306, 308 can be entrained within one or more grooves or tracks defined by the member 302 such that the first and second cables 306, 308 can be wound and unwound relative to the member 302 as the assembly 300 transitions between the first configuration and other configurations.

The member 302 can be substantially similar to, and can include some or all of, the features of the members 110, 200. For example, the member 302 can include a first hub 310, a second hub 312, a first cable track 314, a second cable track 316, a first cable peg 318, and a second cable peg 320. In some examples, the support structure 304 can be an elongate member having a proximal end 322 and a distal end 324. The support structure 304 can be configured to extend from a riser (e.g., riser 102) of an archery bow and support one or more members 302. For example, the support structure 304 can define one or more apertures 326A, 326B at the proximal end 322. One or more fasteners (not shown) can be extended through the one or more apertures 326A, 326B and affixed to the riser to couple the assembly 300 to the archery bow. The support structure 304 can include a retaining feature 328 at the distal end 324. In some examples, the retaining feature 328 can be a pin, dowel, axle, or other projection extending from the support structure 304 and rotatably coupling the member 302 to the support structure 304. Additionally, or alternatively, the retaining feature 328 can be a cavity, volume, through-hole, blind-hole, or another type of recess configured to receive at least a portion of the second hub 312 or an axle to rotatably couple the member 302 to the support structure 304. In some examples, one or more bearings (not shown) can be disposed within the support structure 304 and/or the member 302. In some examples, the member 302 can be coupled to the riser by an additional, or alternative, support structure (not shown) including a retaining feature configured to interconnect with the first hub 310 of the member 302.

In some examples, the first cable track 314 can define or form at least a portion of a periphery of the member 302. For example, the first cable track 314 can extend radially relative to the axis of rotation $A_R$ of the member 302 and/or the first cable peg 318. A distance between the first cable track 314 and the axis of rotation $A_R$ can vary along a length of the first cable track 314 such that a lever arm, defined by a force exerted by the first cable 306 and the distance, can vary relative to an orientation of the member 302 about the axis of rotation $A_R$.

In some examples, the second cable track 316 can define or form at least a portion of a periphery of the member 302. For example, the second cable track 316 can extend radially relative to an axis of rotation $A_R$ of the member 302 and/or the second cable peg 320. While the second cable track 316 is depicted as equidistant from the axis of rotation $A_R$ (i.e., having a substantially uniform radius), a distance or radius between the second cable track 316 and the axis of rotation $A_R$ may vary along a length of the second cable track 316. In some examples, a distance between the second cable track 316 and the axis of rotation $A_R$ can vary along a length of the second cable track 316 such that a lever arm, defined by a force exerted by the second cable 308 and the distance, can vary relative to an orientation of the member 302 about the axis of rotation $A_R$.

FIGS. 3C-3F show the assembly 300 in a second configuration wherein the member 302 is in an energy-locked state (e.g., the member 302 is in a particular orientation that induces and retains additional flex or stress on one or more energy storage devices). In the second configuration of the assembly, the member 302 can be biased by the first cable 306 to remain stationary (i.e., resist rotation about the axis of rotation $A_R$).

In some examples, a first segment 306A of the first cable 306 can wrap or entrain within the first cable track 314 as the assembly transitions from the first configuration to the second configuration (i.e., as the member 302 rotates from a first orientation to a second orientation) such that a second segment 306B of the first cable 306 transitions under a cutout region 330. The cutout region 330 can enable the second segment 306B of the first cable 306 to: transition from one side of the axis of rotation $A_R$; temporarily intersect the axis of rotation $A_R$; and transition to the other side of the axis of rotation $A_R$. In some examples, the axis of rotation $A_R$ can reside on a plane or at least partially define the plane that is parallel to a third segment 308C of the second cable 306. The second segment 306B of the first cable 306 can be on a first side of the plane while the member 302 is in the first orientation. The second segment 306B of the first cable 306 can be on a second side of the plane while the member 302 is in the second orientation.

In some examples, the first cable track 314 and/or the second segment 306B of the first cable 306 can be disposed within the cutout region 330 (e.g., between a body portion 332 of the member 302 and the first hub 310). In some examples, the body portion 332 can support the second cable track 316. In some examples, at least a portion of the first cable track 314 can be laterally offset from the body portion 332. When the second segment 306B of the first cable 306 intersects the axis of rotation $A_R$, a force applied on the member 302 by the first cable 306 may no longer induce a moment on the member 302. Thus, the force applied on the member 302 by the first cable 306 can bias the member 302 to remain in the second configuration (i.e., an energy-locked configuration).

Figure 3D:
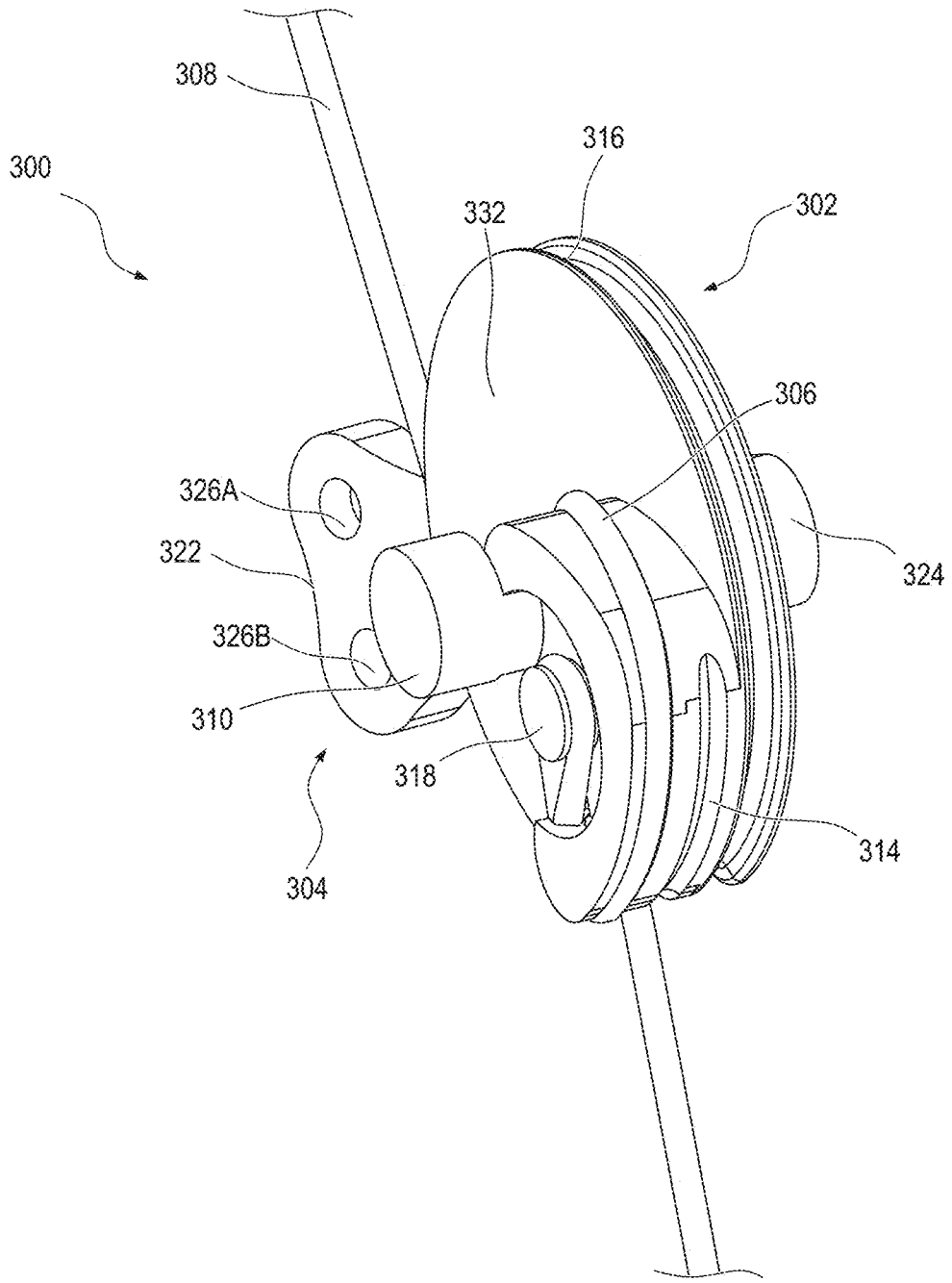
FIG. 3D is a detail perspective rear view of the assembly in the second configuration, according to some embodiments.
Figure 3E:
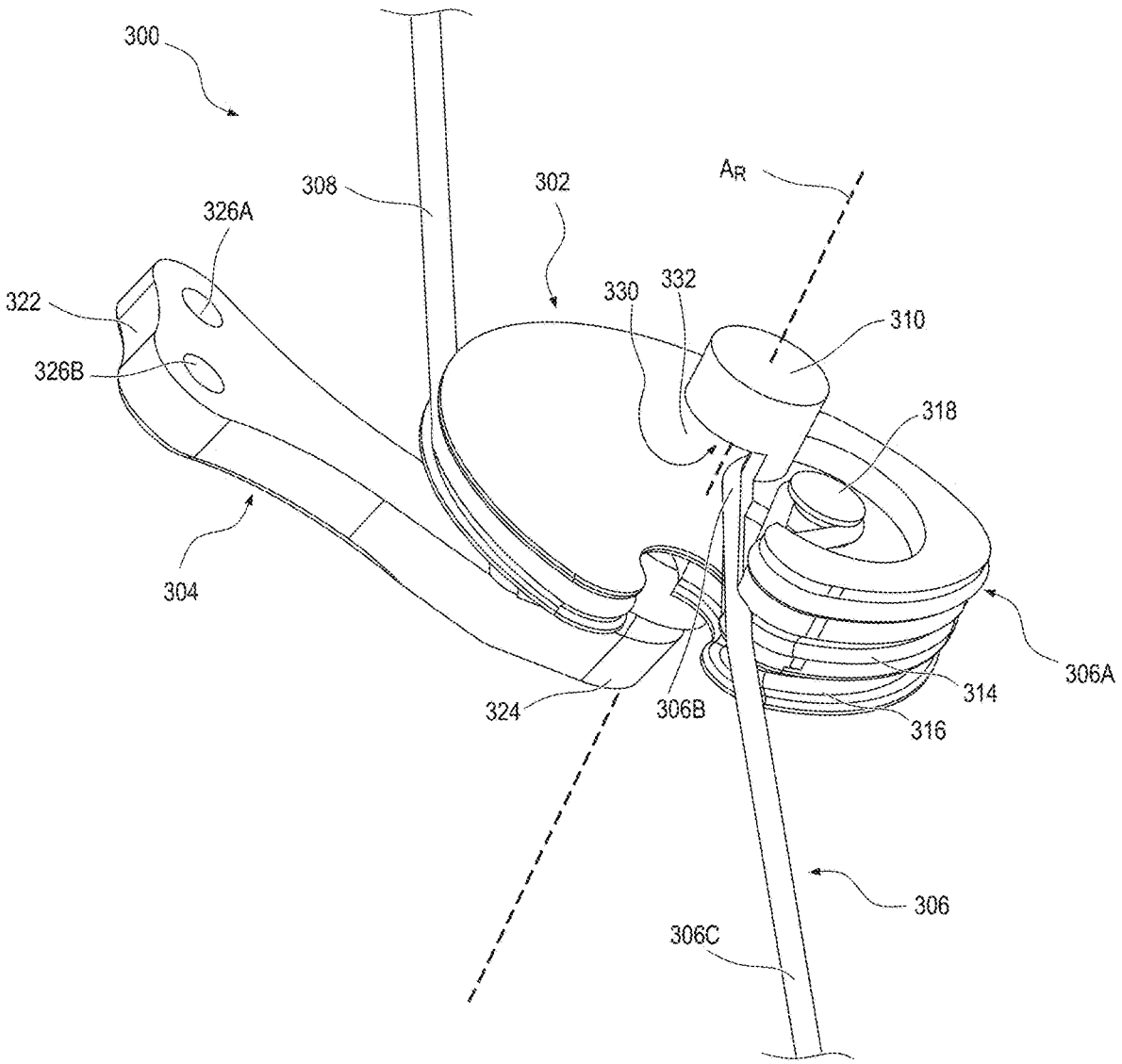
FIG. 3E is a detail perspective bottom view of the assembly in the second configuration, according to some embodiments.
Figure 3F:
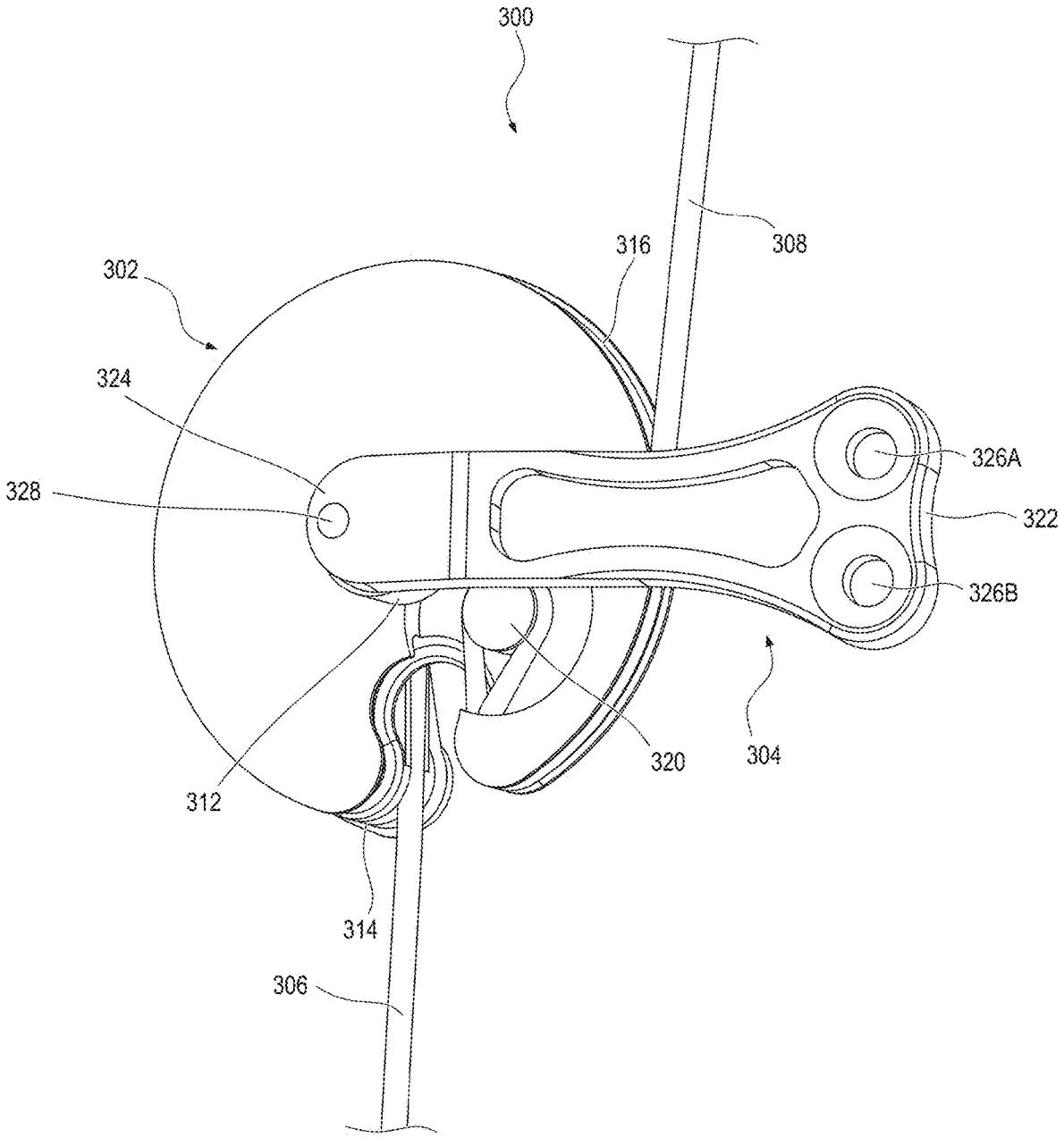
FIG. 3F is a detail perspective side view of the assembly in the second configuration, according to some embodiments.

As shown in FIGS. 3D and 3E, at least a portion of the first cable track 314 can be formed on the member 302 to follow a helical path. In other words, the first cable track 314 can extend or transition toward the second cable track 316 of the member 302, such that the particular segments of the first cable 306 entrained or taken up by the first cable track 314 are laterally offset as the member 302 rotates from the first configuration to the second configuration. For example, the first segment 306A of the first cable 306 can be laterally offset from the second segment 306B of the first cable 306. In some examples, the second cable track 316 can define a plane and at least a portion of the first cable track 314 can extend non-parallel to the plane.

Figure 3G:
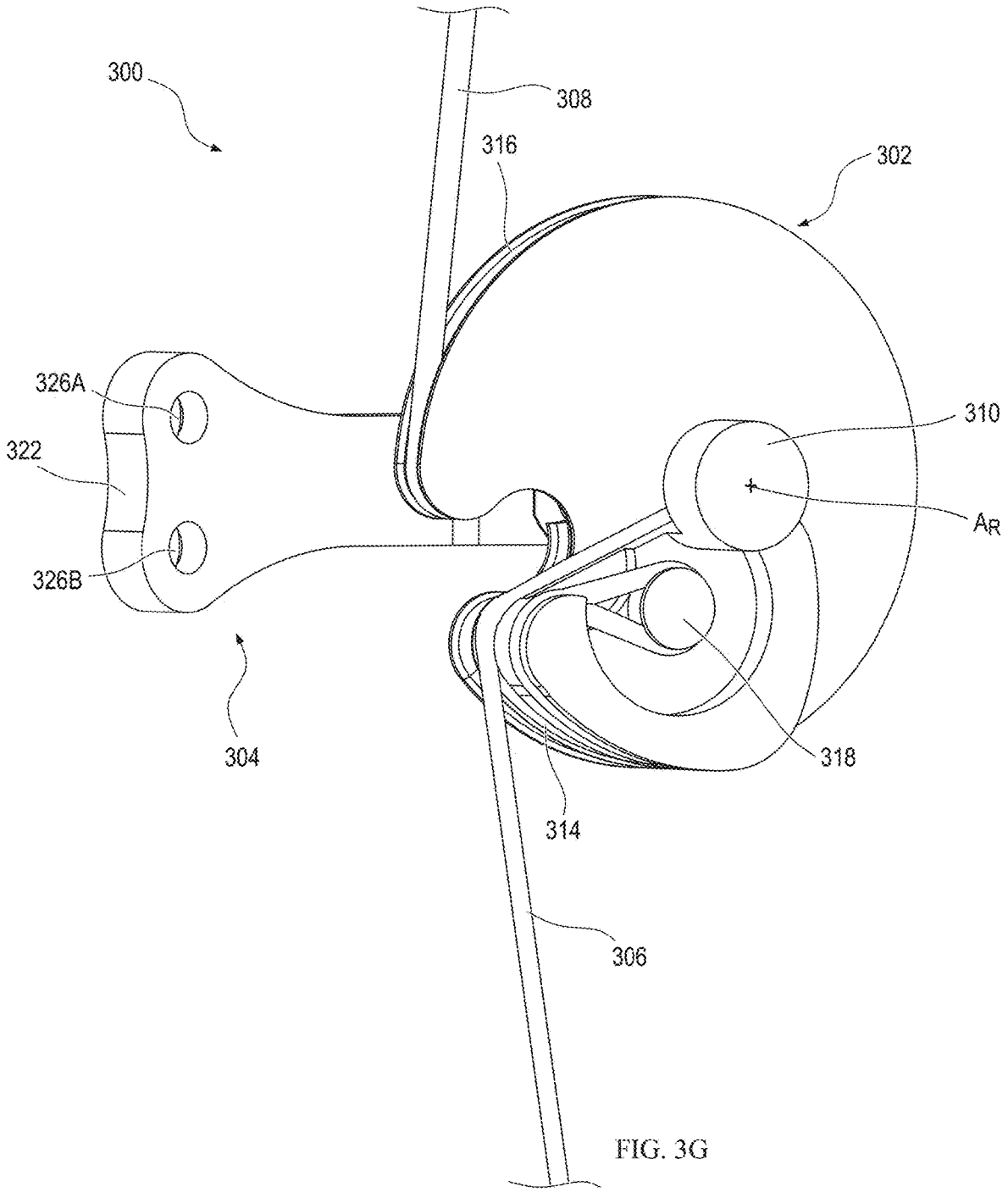
FIG. 3G is a detail perspective side view of the assembly in a third configuration, according to some embodiments.
Figure 3H:
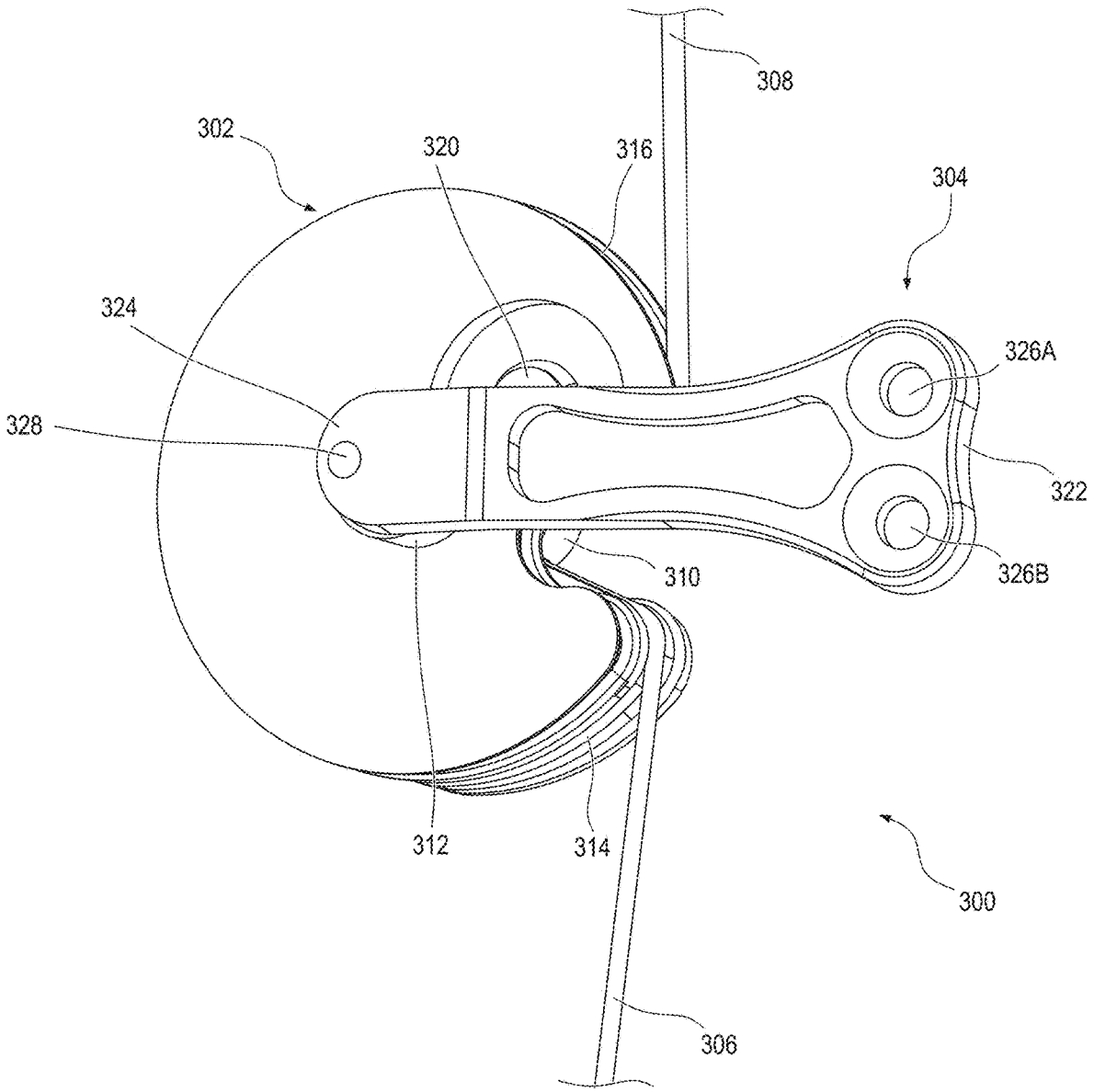
FIG. 3H is a detail perspective side view of the assembly in the third configuration, according to some embodiments.

FIGS. 3G and 3H show the assembly 300 in a third configuration wherein the member 302 has been rotated to a third orientation. In the third configuration, the assembly 300 can be rotated past the second configuration such that the member 302 can be biased to rotate back to the second orientation (i.e., the second configuration) by a moment induced on the member 302 by the first cable 306. While in the third configuration, the assembly 300 can have an associated potential energy that enables the member 302 to generate momentum when the bowstring is released or let down by the archer. If the bowstring is released by the archer, the member 302 can generate an angular momentum sufficient to meet or exceed a threshold momentum for the assembly 300 to return to the first configuration. If the bowstring is let down by the archer, the member 302 may generate an angular momentum that is insufficient to meet or exceed a threshold momentum such that the assembly 300 returns to the second configuration.

FIG. 4A depicts a graph 400 including a draw curve 402 representing a draw force over a draw distance of an archery bow. The draw curve 402 can be associated with a draw force the archer must apply to the bowstring to draw the bow from a brace state (see FIG. 1A) to a fully drawn state (see FIG. 1D). The graph 400 also includes a release curve 404 representing a force applied to a projectile launched from the bow over the draw distance. For example, the release curve 404 can illustrate an energy applied to an arrow launched from the bow as the bow transitions from the fully drawn state to the brace state. The potential energy generated by the archer drawing the bow from the brace state to the fully drawn state can be represented as a total area disposed under the draw curve 402. Similarly, the energy applied to the arrow when launched from the bow can be represented as a total area disposed under the release curve 404. As shown in FIG. 4A, the total energy applied to the arrow when launched is greater than the energy generated by the archer drawing the bow from the brace state to the fully drawn state. In other words, more energy can be transferred into the arrow than the energy generated by the archer drawing the bow from the brace state to the fully drawn state.

In some examples, potential energy can be stored or retained by the archery bow by preemptively drawing the bow to rotate an assembly (e.g., assembly 300) into an energy-locked state (e.g., the second configuration). The archer may subsequently let the bowstring down and return the bow to a brace-state wherein the potential energy is maintained. Additionally, or alternatively, the archer can use a lever or hand tool to rotate the assembly 300 into an energy-locked state while the bow is in the brace position. Thereafter, the archer can draw the bow to a fully drawn state and the potential energy can be transferred such that the archer holds the additional weight associated with the potential energy once a particular or predetermined draw distance 406 is reached.

In some examples, the force associated with the additional potential energy can be transferred from the assembly to the bowstring when an archer pulls the bowstring to a near-fully drawn state (e.g., the draw length associated with reference number 406). When the archer continues to pull the bowstring to transition the bow from the near-fully drawn state to the fully-drawn state 408, the assembly can be further rotated (i.e., to the third configuration) such that releasing the bowstring generates a momentum sufficient to rotate the assembly out of the energy-locked state, as described with reference to FIGS. 2A-3H. Thus, a total energy transferred to the arrow during launch (see release curve 404) is greater than a partial energy associated with the draw force the archer experiences while drawing the bow (see draw curve 402).

In some examples, the archery bow can include cams having a draw force let-off that reduces or substantially diminishes the additional force associated with the additional potential energy transferred from the assembly to the bowstring. For example, the cams can have an 80% let-off significantly reducing the additional force from the additional potential energy held by the archer at full draw. A substantial let-off (i.e. above 80% let-off) can result in the archer feeling/holding very little (if any) of the additional force from the additional potential energy.

FIG. 4B depicts a graph 410 including a first draw curve 412 correlating to a draw weight generated by a primary energy storage device (e.g., limbs 104, 106) when the archer draws the bow from a brace state to a fully drawn state. The graph 410 also include a second draw curve 414 correlating to a draw weight generated by a second energy storage device (e.g., a secondary set of limbs, coiled springs, or other energy storage mechanism in addition to the primary energy storage device) when the archer at least partially draws the bowstring of the bow or rotates the assembly with a lever or hand tool. The graph 410 also include a combined draw curve 416 correlating to a combination or summation of the first draw curve 412 and the second draw curve 414. In some use cases, the archer can draw the bow after rotating the assembly to the energy-locked state such that the archer experiences the first draw curve 412 correlating to a draw weight generated by a primary energy storage device. In some use cases, the archer can draw the bow without prior rotation of the assembly to the energy-locked state. In these use cases, the archer can experience the combined draw curve 416 correlating to a draw weight generated by a primary energy storage device and a secondary energy storage device. Thus, the bow will accurately and reliably launch arrows down range regardless of whether the archer energizes the assembly (i.e., rotates the assembly from the first configuration to the second configuration) prior to drawing the bow.

Another aspect of the present disclosure generally relates to incorporating one or more members with one or more archery accessories. For example, one or more members can be incorporated within a housing of a fall-away or a drop-away arrow rest. As described herein, the member can be biased to remain in a particular orientation or configuration until a momentum associated with the member rotating causes the member to overcome the bias and rotate past the orientation or configuration. Upon rotation of the member, an arrow support structure of the arrow rest can be rotated out of contact with the arrow or other projectile when the archer releases the bowstring to launch the projectile. Rotating the arrow support structure out of contact with the arrow can enable the arrow to exit the archery bow during launch without undesirable contact between the arrow rest and the arrow.

However, if the momentum of the member does not meet or exceed a threshold associated with the biasing force (i.e., the archer lets the draw string down slowly), the arrow support structure can remain in contact with the arrow (e.g., the arrow support structure can remain upright to support the arrow). The member can be a wheel coupled to a biasing element configured to bias the wheel to rotate in a first direction while the wheel is in a first orientation and bias the wheel to rotate in a second direction while the wheel is in a second orientation. In some examples, the member or wheel can be indirectly coupled to the biasing element by a cable, string, band, or other linkage. In some examples, the biasing element can be directly coupled to the member or wheel.

In some examples, the member can be a cam, wheel, eccentric, or other member incorporated into the archery bow accessory. For example, the one or more members can be affixed on and/or within an arrow rest for an archery bow to facilitate arrow support while an archer launches a projectile. For example, the member can be rotated from a first configuration to a second configuration by a draw cord when the archery bow is at least partially drawn by the archer. While the member is in the second configuration, one or more biasing elements can apply a torque to the member which biases the member to remain in the second configuration. For example, as the member is rotated into the second configuration, forces or torques exerted on the member by the one or more biasing elements can vary in both magnitude and direction to bias the member to remain in the second configuration. While in the second configuration, an arrow support of the arrow rest can retain an arrow at an elevated position, such as, elevated above a shelf defined by a riser of the archery bow. While in the elevated position, the arrow can be supported within or substantially close to a desired shooting axis and or plane defined by the archery bow.

In some examples, the archer can draw the archery bow (e.g., pull the bowstring from a brace position) to implement rotation of the member within the arrow rest from the first configuration to the second configuration. For example, a cord, cable, or other linkage can be coupled between the arrow rest and a cable and/or a limb of the archery bow to rotate the member as the bowstring is drawn by the archer. The archer can further draw the bowstring to rotate the member within the arrow rest from the second configuration to a third configuration. Rotation to the third configuration can generate a moment biasing the member to rotate back toward the second configuration when the archer releases the bowstring. After the bowstring is released, a resultant momentum of the member can be sufficient to overcome the torque exerted by the one or more biasing elements on the member to enable the member to rotate past the second configuration to the first configuration, thereby rapidly rotating the arrow support toward the riser shelf of the archery bow to provide clearance for the projectile. In other words, the member can be coupled to the arrow support such that rotation of the member causes the arrow support to rotate out of contact with the arrow and enable the arrow to be launched from the archery bow without contacting the arrow rest as the arrow departs the bowstring. In some examples, the archer can let the bowstring down relatively slowly such that the member does not have a threshold momentum required to overcome the torque biasing the member to remain in the second configuration. In these examples, the member can return to the second configuration and the arrow support can retain the projectile in an elevated position relative to the arrow shelf for a subsequent shot.

In some examples, the arrow rest can include a single biasing element at least partially disposed within a housing. The biasing element is coupled to the member which is rotatable about an axis of rotation. The member is rotatable in a first direction from a first orientation to a second orientation. The biasing element can apply a first torque to the member biasing the member to remain in the second orientation. The member is rotatable in the first direction from the second orientation to a third orientation. In the third orientation, the biasing element contacts a protrusion in the third orientation which generates a second torque on the member biasing the member to rotate in a second direction that is different from the first direction. In some examples, the protrusion can contact the biasing element at location disposed between respective ends of the biasing element. The protrusion can be affixed, molded, fastened, or otherwise disposed on the member. In some examples, the protrusion can be affixed to the housing and remain stationary as the member rotates between the first, second, and third orientations.

In some examples, the arrow rest can include more than one biasing element such as two or more biasing elements. For example, the arrow rest can include a first or primary biasing element and a second or secondary biasing element. The first biasing element can apply a first torque to the member biasing the member to remain in the second orientation. The second biasing element can contact the member while the member is in the third orientation and generate a second torque sufficient to overcome the first torque to rotate the member from the third orientation, past the second orientation, to the first orientation. The one or more biasing elements can be torsion springs, compression springs, tension springs, a combination thereof, or any other spring. Additionally, or alternatively, the one or more biasing elements can be formed as structures that undergo elastic deformation when a stress or strain is applied. For example, the one or more biasing elements can be formed from a urethane or other polymer capable of deforming to generate a force or torque biasing the member to rotate.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, features described with respect to certain embodiments may be combined in other embodiments.

FIGS. 5A-5E show an arrow rest 500 in multiple configurations or states of operation. The arrow rest 500 can include a mount 502, a housing 504, an arrow support 506. The mount 502 can include one or more features that enable the arrow rest 500 to be coupled to an archery bow. For example, the mount 502 can have an aperture or slot 503 that a fastener (not shown) can be extended through to couple the arrow rest 500 to the archery bow. In some examples, the mount 502 and/or housing 504 can include one or more features that enable the arrow rest 500 to be coupled to an archery bow. For example, the mount 502 and/or housing 504 can include a dovetail feature (not shown) that engages and interlocks with a correlating feature on a riser of the archery bow.

In some examples, the mount 502 can be affixed, fastened, adhered, interlocked, or otherwise coupled to the housing 504. In some examples, the mount 502 can be integrally formed with the housing 504 as a singular component. One or more components that enable the arrow rest 500 to operate as a drop-away arrow rest can be disposed within a cavity or volume at least partially defined by the housing 504. The housing 504 and components at least partially disposed within the housing 504 will be described in further detail herein with reference to FIGS. 5C-5E.

Figure 5A:
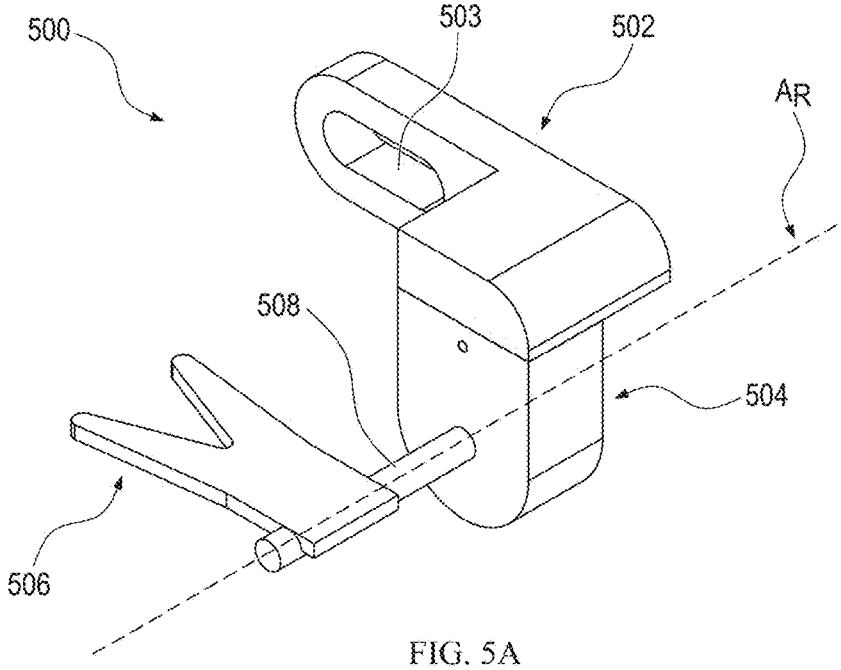
FIG. 5A shows a perspective side view of an arrow rest in a first state, according to some embodiments.
Figure 5B:
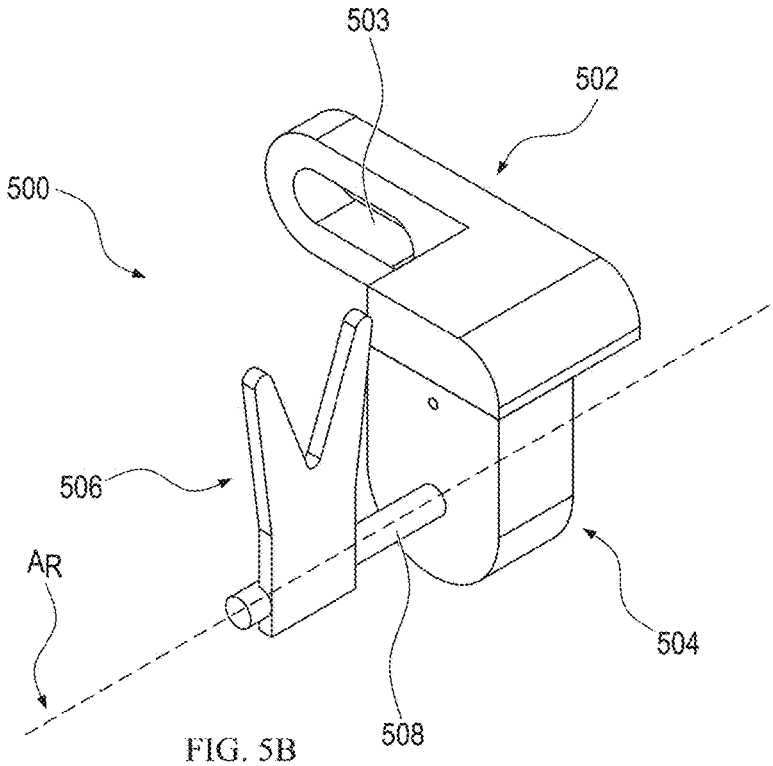
FIG. 5B shows a perspective side view of the arrow rest in a second state, according to some embodiments.

The arrow support 506 can include one or more features or shapes capable of at least partially retaining a projectile (e.g., an arrow) in an elevated position relative to an arrow shelf of an archery bow riser. The arrow support 506 can be directly or indirectly coupled to one or more of the mount 502 and the housing 504. For example, the arrow support 506 can be fastened, adhered, molded, or otherwise affixed to a shaft 508 that extends from the mount 502 and/or the housing 504. The arrow support 506 can be repositioned or reoriented relative to the mount 502 and/or the housing 504 when the shaft 508 is rotated. For example, FIG. 5A shows the arrow rest 500 in a first state or first configuration wherein the arrow support 506 is laying horizontal (i.e., substantially parallel to the arrow shelf of the archery bow). FIG. 5B shows the arrow rest 500 in a second state or second configuration wherein the arrow support 506 is standing vertical (i.e., substantially perpendicular to the arrow shelf of the archery bow). In the first state, the arrow support 506 can be disengaged or substantially out of contact with a projectile coupled to the archery bow. In the second state, the arrow support 506 can engage the projectile to retain the projectile in a shooting or launching position. When the archery bow is drawn and the projectile is launched, the arrow rest 500 can transition from the second state to the first state such that the arrow support 506 does not remain in contact with the projectile during an entirety of the launch. In other words, the arrow support 506 can maintain contact with the projectile but rotate out of contact to enable vanes or other features of the projectile to clear the arrow support 506 without contact.

Figure 5C:
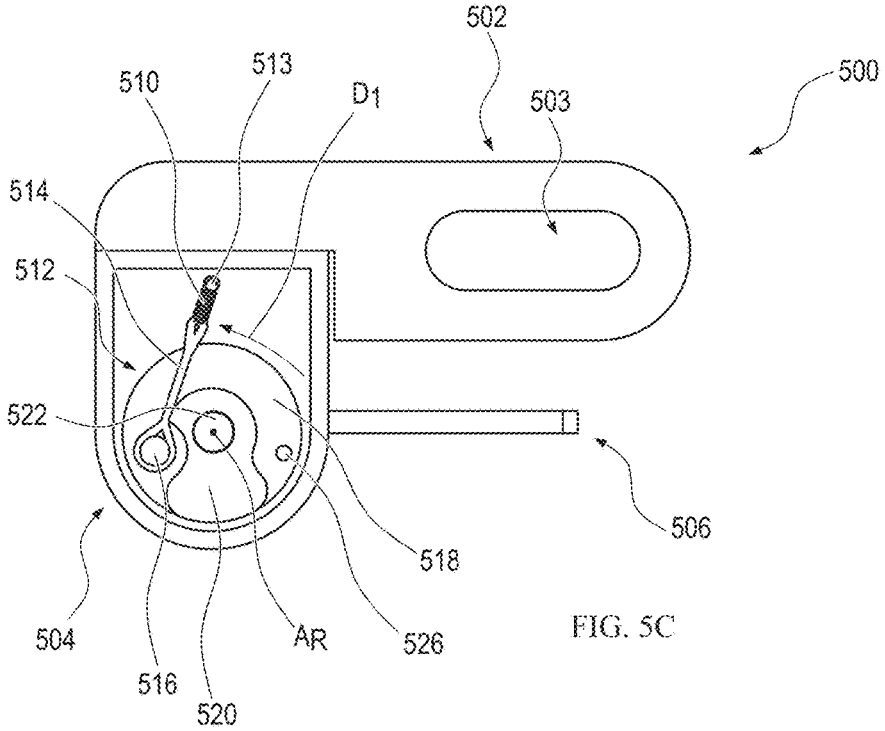
FIG. 5C shows a side view of the arrow rest in the first state, according to some embodiments.

FIG. 5C shows a detail side view of the arrow rest 500 in the first state or first configuration. In some examples, the arrow rest 500 can include a biasing element 510 and a member 512 disposed within a cavity or volume at least partially defined by the housing 504. In some examples, the biasing element 510 can be directly coupled to the member 512. For example, the biasing element 510 can be coupled to the housing 504 at one end and coupled to the member 512 at the other end. The biasing element 510 can be coupled to the housing 504 by a fastener, a peg, an adhesive, a slot, an aperture, a combination thereof, or otherwise coupled to the housing 504 using any other feature 513 or process for coupling components together. In some examples, the biasing element 510 can be indirectly coupled to the housing 504 and/or the member 512. For example, as shown in FIG. 5C, the arrow rest 500 can include a cable 514 or linkage and a combination of the cable 514 and the biasing element 510 can extend from the housing 504 and the member 512. In some examples, a peg or other attachment feature 516 can be formed or fastened to the member 512 to enable coupling the biasing element 510 and/or the cable 514 to the member 512.

The shaft 508 can be directly or indirectly coupled to the member 512 such that rotation of the member 512 induces a rotation of the shaft 508 and thereby causes the arrow support 506 to transition between horizontal and vertical positions (e.g., first and second states). In some examples, the shaft 508 and the member 512 can be rotatable about a shared axis of rotation $A_R$. While in the first state or first configuration, the member 512 can be disposed in a first orientation or first configuration. When the archery bow is drawn, a drawcord (not shown) can be tensioned to cause the arrow rest 500 to transition from the first state (e.g., see FIG. 5A and FIGS. 5C-5D) to the second state (see FIG. 5B and FIGS. 5E-5F) such that the member 512 is rotated in a first direction $D_1$ from the first orientation to a second orientation or second configuration. The member 512 can rotate at least 70 degrees when the member 512 transitions between the first orientation and the second orientation. Due to the intercoupled relationship between the member 512 and the arrow support 506 via the shaft 508, the arrow support 506 can rotate when the member 512 transitions between the first orientation and the second orientation.

Figure 5D:
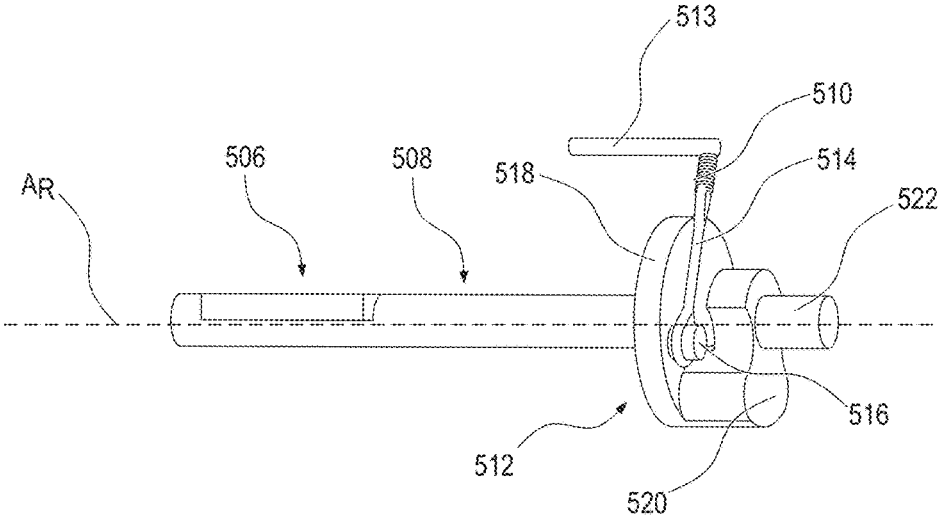
FIG. 5D shows a detailed perspective side view of the arrow rest in the first state, according to some embodiments.

FIG. 5D shows a detail view of the arrow rest 500 without the mount 502 and the housing 504. In some examples, the member 512 can include a base portion 518, a stand-off 520, and a hub or engagement portion 522. The base portion 518 can be coupled to the shaft 508 such that rotation of the base portion 518 causes the shaft 508 to rotate and vice versa. In some examples, the attachment feature 516 can be defined by or otherwise coupled to the base portion 518. For example, the attachment feature 516 can be a peg extending from the base portion 518. In some examples, the base portion 518, the stand-off 520, and the engagement portion 522 can be integrally formed or otherwise formed as a singular component. In some examples, one or more of the base portion 518, the stand-off 520, and the engagement portion 522 can be distinct components that are molded, adhered, fastened, or otherwise affixed to one another. While the member 512 is shown in FIG. 5D as including the base portion 518, the stand-off 520, and the engagement portion 522, the member 512 can include more or fewer components. For example, the member 512 may only include the base portion 518 in some examples. In other words, the stand-off 520 and the engagement portion 522 may not be required components of the member 512 to realize the aspects and benefits outlined in the present disclosure.

In some examples, the base portion 518 and the stand-off 520 can form or define an undercut region or cutout region 524 in which at least a portion of the biasing element 510 and/or the cable 514 can be disposed within while the member 512 is in one or more of the first, second, or third orientations shown in FIGS. 5C-5H. In other words, the cutout region 524 can enable a portion of the biasing element 510 and/or the cable 514 to: transition from one side of the axis of rotation $A_R$; temporarily intersect the axis of rotation $A_R$; and transition to the other side of the axis of rotation $A_R$ as the member 512 rotates during operation of the arrow rest 500.

The engagement portion 522 can contact or engage the arrow rest 500 to support the member 512 within the housing 504. In some examples, the engagement portion 522 can be a pin, dowel, axle, or other projection extending from the stand-off 520 and rotatably couple the member 512 to the housing 504. Additionally, or alternatively, the stand-off 520 can be a cavity, volume, through-hole, blind-hole, or another type of recess configured to receive at least a portion of a portion of the housing 504 to rotatably couple the member 512 to the housing 504. In some examples, one or more bearings (not shown) can be disposed within the housing 504 and/or the member 512. In some examples, the member 512 can be coupled to the arrow rest 500 by an additional, or alternative, support structure (not shown) including a retaining feature configured to interconnect with the engagement portion 522 of the member 512.

Figure 5E:
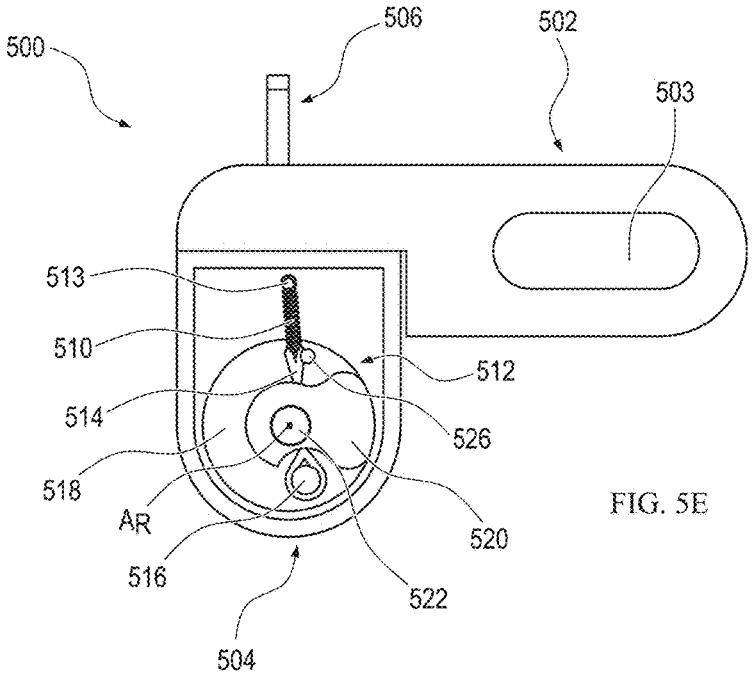
FIG. 5E shows a side view of the arrow rest in the second state, according to some embodiments.
Figure 5F:
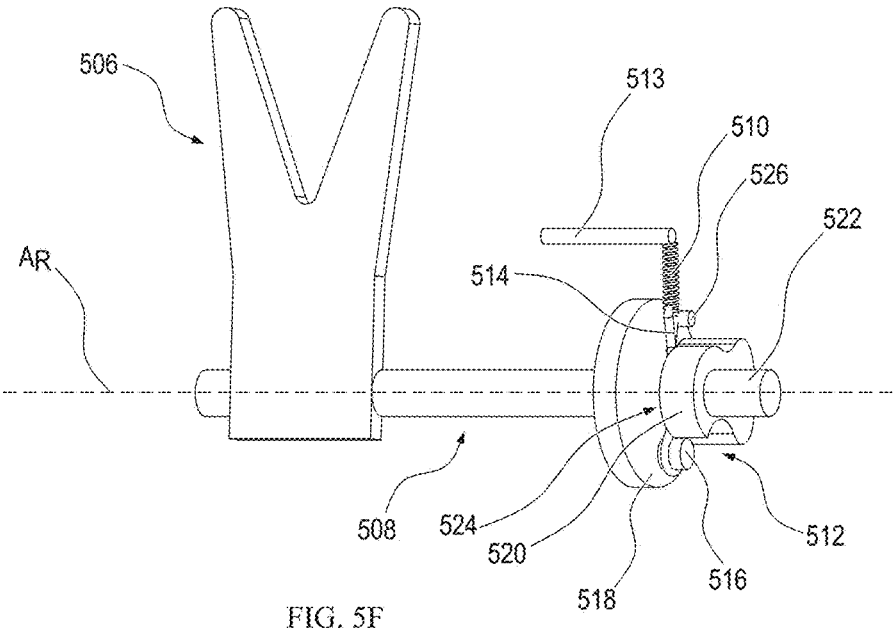
FIG. 5F shows a detailed perspective side view of the arrow rest in the second state, according to some embodiments.

FIG. 5E and FIG. 5F show the arrow rest 500 in the second state or second configuration. In the second state, the member 512 can be disposed in the second orientation and the biasing element 510 can apply or induce a first torque that biases the member 512 to remain in the second orientation. In some examples, a portion of the biasing element 510 and/or the cable 514 can be disposed within the cutout region 524 and at least momentarily intersect the axis of rotation $A_R$ while the member 512 is in the second orientation.

Figure 5G:
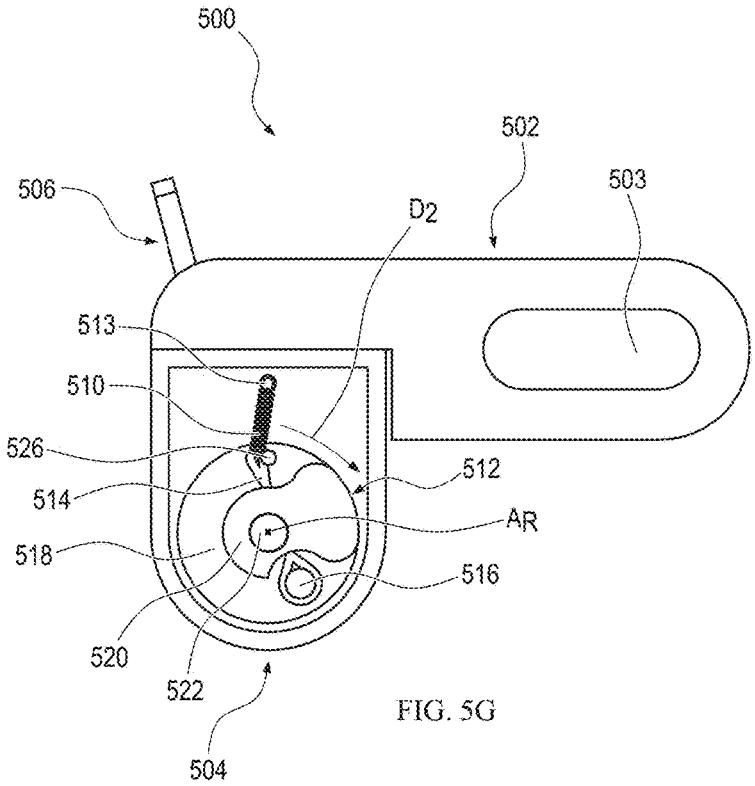
FIG. 5G shows a side view of the arrow rest in the third state, according to some embodiments.
Figure 5H:
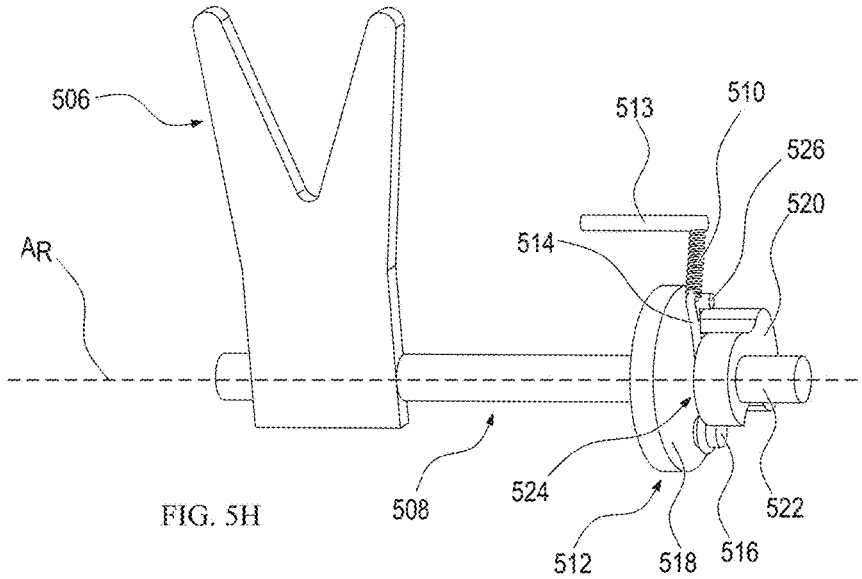
FIG. 5H shows a detailed perspective side view of the arrow rest in the third state, according to some embodiments.

As the archery bow reaches a fully-drawn state (e.g., see FIG. 1D), the member 512 can rotate in the first direction $D_1$ to a third orientation (see FIG. 5G and FIG. 5H). In some examples, a portion of the biasing element 510 and/or the cable 514 can be disposed within the cutout region 524 while the member 512 is in the third orientation. In the third orientation, the biasing element 510 can apply or induce a second torque on the member 512. For example, the member 512 can include a protrusion 526 or other feature that extends from the member 512 and engages the biasing element 510 and/or the cable 514 as the member 512 rotates in the first direction $D_1$ to the third orientation. For example, the protrusion 526 can extend from the base portion 518 and rotate into contact with the biasing element 510 (or another component). The contact can generate a force inducing a torque on the member 512 opposing rotation in the first direction $D_1$. The second torque can induce the member 512 to rotate in a second direction $D_2$, opposite the first direction $D_1$. In some examples, such as, when the bow string is released, the second torque can generate an angular momentum of the member 512 sufficient to overcome the first torque to rotate the member 512 in the second direction $D_2$ from the third orientation, past the second orientation, to the first orientation. In some examples, such as when the bow string is let down slowly by the archer, the second torque may not generate an angular momentum of the member 512 sufficient to overcome the first torque such that the member 512 rotates in the second direction $D_2$ from the third orientation to the second orientation and remains in the second orientation. The protrusion 526 can be offset a distance from the axis of rotation $A_R$ such as at or near a periphery of the base portion 518.

Figure 5I:
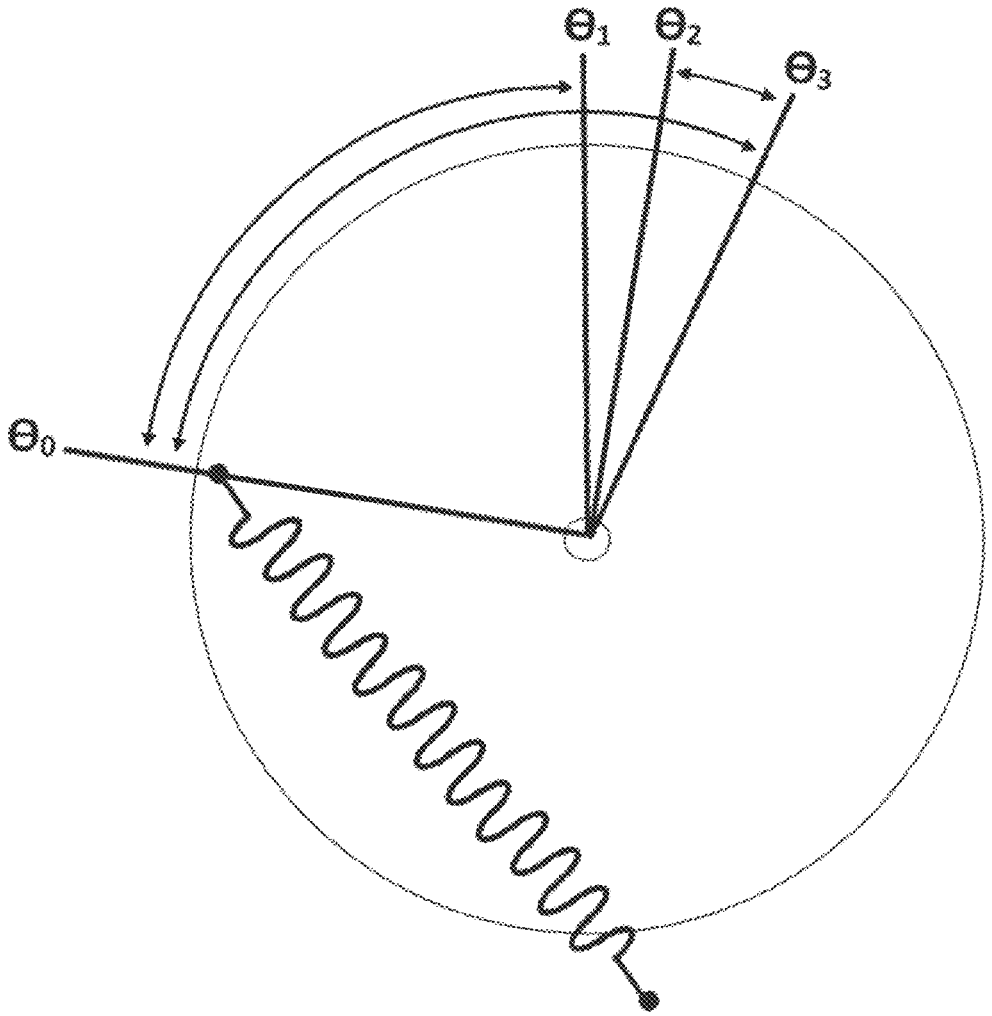
FIG. 5I shows a side view of a diagram representative of angular translation of an arrow rest, according to some embodiments.
Figure 5J:
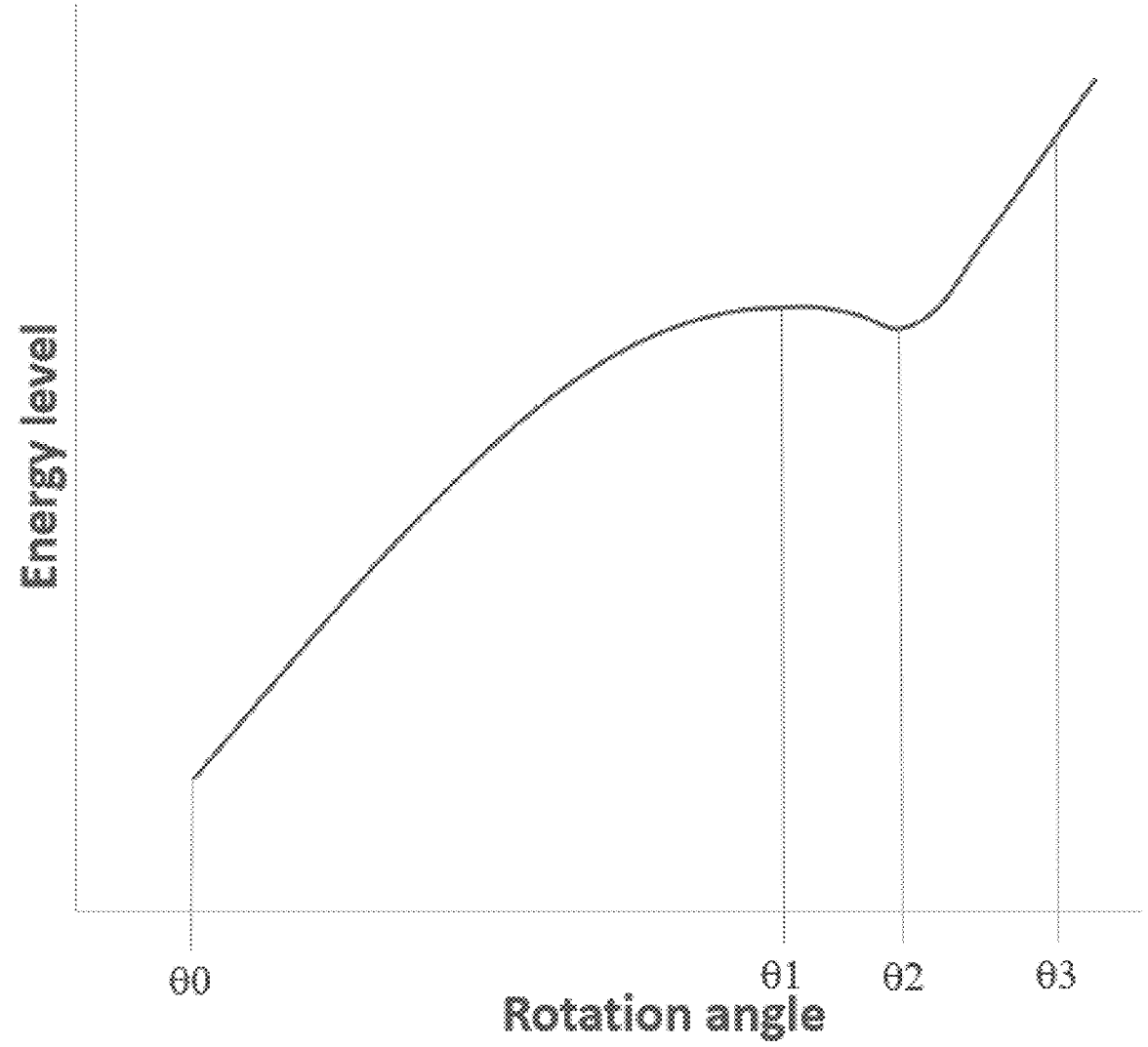
FIG. 5J shows a graphical representation of the energy state of an arrow rest correlated with an angular translation, according to some embodiments.

In some examples, an energy state ES or energy level attributable to the arrow rest 500 while the bow is drawn is equivalent to a total potential energy $PE_T$ and a total kinetic energy $KE_T$ of the arrow rest 500 in the various states or configurations (see Equation 3 below). In other words, the energy state ES attributable to the arrow rest 500 while the bow is being drawn is equivalent to a total potential energy $PE_T$ and a total kinetic energy $KE_T$ associated with the member 512 at the various orientations of the member 512. For example, as the archery bow is drawn, the arrow rest 500 can be transitioned from the first configuration to the second or third configurations. Thus, the energy state ES associated with the arrow rest 500 while the bow is being drawn is a summation of respective torque induced on the member 512 as the member rotates from the first orientation to the second or third orientations. A graphical example of the energy state is shown in FIG. 5J. While drawing the bow, the total kinetic energy $KE_T$ of the arrow rest 500 is zero and the total potential energy $PE_T$ is dependent upon the amount of angular rotation undergone by the member 512.

$$ES=PE_T+KE_T \quad \text{EQUATION 3}$$

A potential energy $PE_1$ associated with translation of the member 512 from the first orientation $\theta_0$ to an orientation $\theta_1$ (i.e., an orientation the member 512 is initially biased to remain in the second configuration) is a summation (e.g., integration) of torque $\tau_1$ induced on the member 512 by the biasing element 512 over the angular translation from the first orientation $\theta_0$ to the orientation $\theta_1$ (see FIG. 5I and Equation 4 below). The potential energy $PE_2$ associated with translation from the first orientation $\theta_0$ to the third orientation $\theta_3$ is $PE_1$ minus a summation (e.g., integration) of torque $\tau_2$ induced on the member 512 by the biasing element 512 over the angular translation from the orientation $\theta_1$ to the third orientation $\theta_3$ (see FIG. 5I and Equation 5 below). The total potential energy $PE_T$ associated with translation of the member 512 from the first orientation $\theta_0$ to the third orientation $\theta_3$ is the potential energy $PE_2$ plus a summation (e.g., integration) of torque $\tau_3$ induced on the member 512 by the contact between the biasing element 512 and the protrusion 526 over the angular translation from the second orientation $\theta_2$ to the third orientation $\theta_3$ (see FIG. 5I and Equation 6 below). The total potential energy $PE_T$ of the arrow rest 500 is shown as Equation 7 below and graphically illustrated in FIG. 5J.

$$PE_1=\int_{\theta_0}^{\theta_1}\tau_1 d\theta \quad \text{EQUATION 4}$$

$$PE_2=PE_1-\int_{\theta_1}^{\theta_3}\tau_2 d\theta \quad \text{EQUATION 5}$$

$$PE_T=PE_2+\int_{\theta_2}^{\theta_3}\tau_3 d\theta \quad \text{EQUATION 6}$$

$$PE_T=\int_{\theta_0}^{\theta_1}\tau_1 d\theta-\int_{\theta_1}^{\theta_3}\tau_2 d\theta+\int_{\theta_2}^{\theta_3}\tau_3 d\theta \quad \text{EQUATION 7}$$

When the arrow rest 500 is in the third configuration (e.g., when the archery bow is in a full draw condition (see FIG. 1D)), the potential energy can be converted to kinetic energy as the archer releases (or lets-down) the bowstring. As shown in FIG. 5J, in order for the arrow rest 500 to translate from the third configuration (e.g., orientation $\theta_3$), past the second configuration (e.g., orientation $\theta_2$), to the first configuration (e.g., orientation $\theta_0$), the total potential energy $PE_T$ must be sufficient to overcome a stabilizing energy SE associated with the second configuration (see Equation 8 below). Otherwise, the member 512 will not have sufficient energy to overcome the stabilizing energy SE biasing the member 512 to remain in the second orientation $\theta_2$. In some examples, the arrow rest 500 may only rotate past the second configuration if the kinetic energy KE exceeds a threshold amount greater than the stabilizing energy SE. In other words, the arrow rest 500 may only transition from the third configuration, past the second configuration, to the first configuration when the a summation (e.g., integration) of torque $\tau_3$ induced on the member 512 by the contact between the biasing element 512 and the protrusion 526 over the angular movement from the second orientation $\theta_2$ to the third orientation $\theta_3$ is greater than the stabilizing energy SE (see Equation 9 below). Otherwise, the energy associated with the torque $\tau_3$ may be insufficient to overcome the stabilizing energy SE and the arrow rest will simply transition from the third configuration to the second configuration. This aspect of the present disclosure is beneficial in providing an arrow rest that can fall-away or remain upright dependent upon whether the bowstring is released by the archer or whether the bowstring is let-down relatively slowly by the archer.

$$SE=\int_{\theta_1}^{\theta_3}\tau_2 d\theta \quad \text{EQUATION 8}$$

$$\int_{\theta_2}^{\theta_3}\tau_3 d\theta-SE>0 \quad \text{EQUATION 9}$$

Figure 6A:
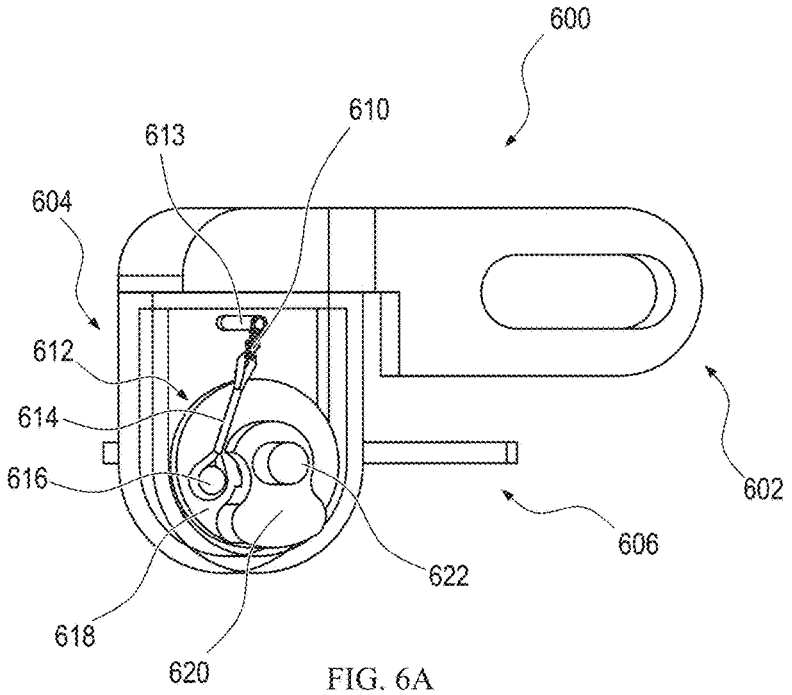
FIG. 6A shows a perspective side view of an arrow rest in a first state, according to some embodiments.

FIG. 6A shows another example of an arrow rest 600 according to the present disclosure. The arrow rest 600 can be similar to, and can include some or all of the features of the arrow rest 500. For example, the arrow rest 600 can include a mount 602, a housing 604, and an arrow support 606 coupled to the housing 604 by a shaft 608. The mount 602, the housing 604, and the arrow support 606 can be substantially similar to, and can include some or all of the features of the mount 502, the housing 504, and the arrow support 506, respectively. FIG. 6A shows the arrow rest 600 in a first state or first configuration wherein the arrow support 606 is laying horizontal (i.e., substantially parallel to the arrow shelf of the archery bow). In some examples, a biasing element 610 and a member 612 can be at least partially disposed within a cavity or volume defined the housing 604. In some examples, the biasing element 610 can be coupled or affixed to the housing 604. For example, the biasing element 610 can be coupled to the housing 604 by a fastener, a peg, an adhesive, a slot, an aperture, a combination thereof, or otherwise coupled to the housing 504 using any other feature 613 or process for coupling components together. In some examples, the biasing element 610 can be indirectly or directly coupled to the member 612, for example, by a cable 614 or other linkage.

The member 612 can be substantially similar to, and can include some or all of the features of the member 512. For example, the member 612 can include a peg or other attachment feature 616, a base portion 618, a stand-off 620, an engagement portion 622, and an undercut or cutout region 624 formed or defined by the base portion 618 and the stand-off 620. While the member 612 is shown in FIGS. 6A-6F as including the base portion 618, the stand-off 620, and the engagement portion 622, the member 612 can include more or fewer components in other examples. For example, the member 612 may only include the base portion 618 in some examples. In other words, the stand-off 620 and the engagement portion 622 may not be required components of the member 612 to realize the aspects and benefits outlined in the present disclosure.

Figure 6B:
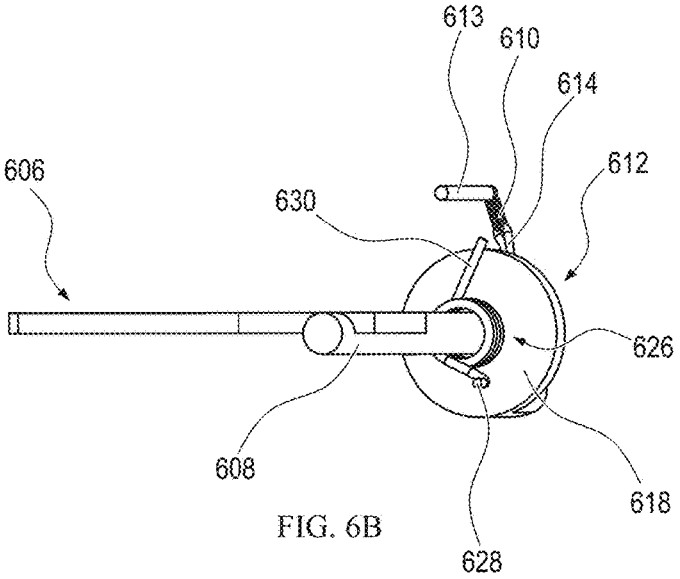
FIG. 6B shows a detailed perspective side view of the arrow rest in the first state, according to some embodiments.
Figure 6C:
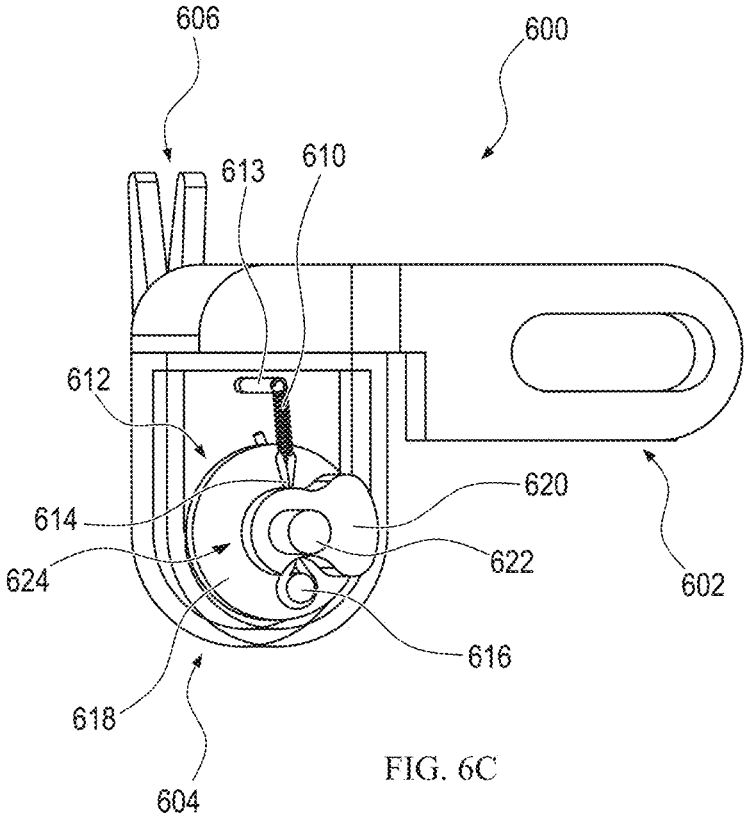
FIG. 6C shows a perspective side view of the arrow rest in a second state, according to some embodiments.
Figure 6D:
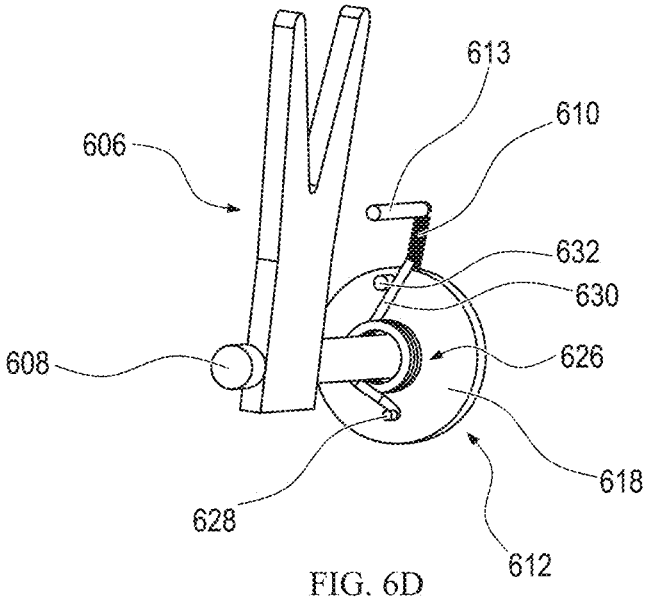
FIG. 6D shows a detailed perspective side view of the arrow rest in the second state, according to some embodiments.
Figure 6E:
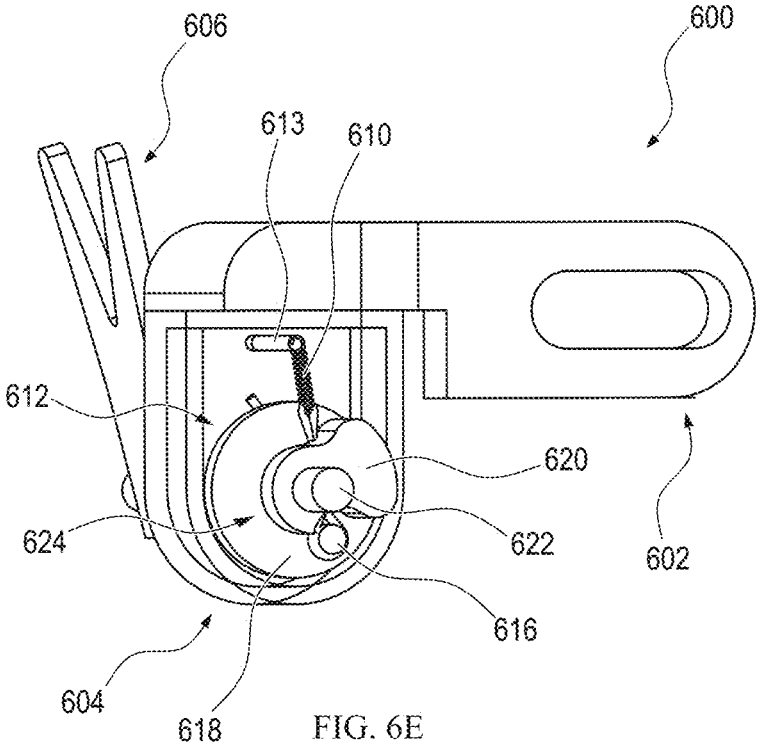
FIG. 6E shows a perspective side view of the arrow rest in a third state, according to some embodiments.
Figure 6F:
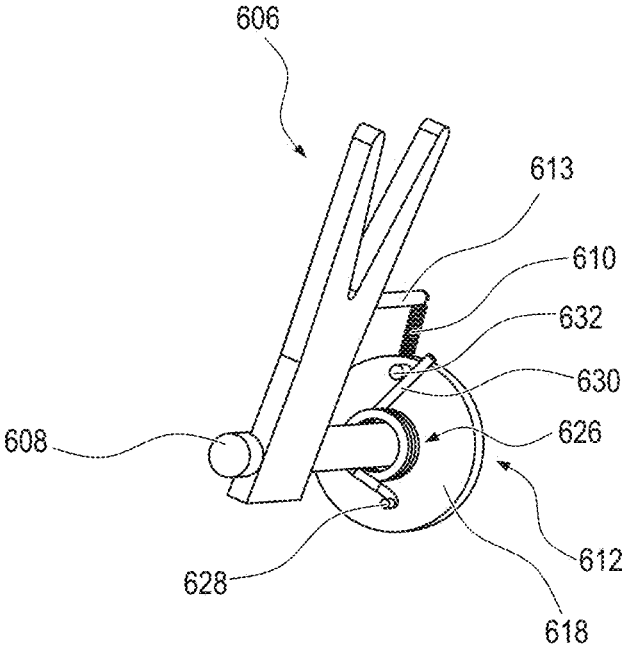
FIG. 6F shows a detailed perspective side view of the arrow rest in the third state, according to some embodiments.

In some examples, the arrow rest 600 can operate as described above with reference to FIGS. 5A-5H wherein a protrusion (not shown in FIGS. 6A-6F, see the protrusion 526) may contact the biasing element 610 and/or the cable 614 while the member 612 is in a third orientation (see FIG. 6E). Additionally, or alternatively, the biasing element 610 can be a primary biasing element and the arrow rest 600 can include a secondary biasing element 626. In some examples, the secondary biasing element 626 can be a torsion spring. In some examples, the secondary biasing element 626 can be a coil spring (e.g., a tension or compression spring). In some examples, the secondary biasing element 626 can be a leaf spring or flexible member. In some examples, the secondary biasing element 626 can be a magnet or electro-magnet. In some examples, the primary biasing element 610 and the secondary biasing element 626 can be disposed on opposite lateral sides of the member 612.

While depicted as a torsion spring disposed about the shaft 608 in FIGS. 6A-6F, the secondary biasing element 626 can be any number and combination of springs, deformable materials, or magnets disposed at any location within or on the archery rest 600 and contacting one or more components within the archery rest 600. In a first state or first configuration of the arrow rest 600, the member 612 can be in a first orientation (see FIG. 6A) wherein the secondary biasing element 626 does not exert any torque on the member 612. FIG. 6B shows a detail view of the arrow support 606, the shaft 608, the member 612, and the secondary biasing element 626. The secondary biasing element 626 can contact or otherwise be coupled to one or more components of the arrow rest 600. For example, the secondary biasing element 626 can be a torsion spring with a first arm 628 contacting the housing 604, such as, a recess or aperture within the housing 604. The secondary biasing element 626 can have a second arm 630 positioned adjacent the base portion 618. The second arm 630 can be oriented and arranged to contact one or more surfaces of the member 612 when the member 612 is rotated between various orientations or configurations.

FIG. 6C shows the arrow rest 600 in the second state or second configuration. In the second state, the member 612 can be disposed in the second orientation and the primary biasing element 610 can apply or induce a first torque that biases the member 612 to remain in the second orientation. In some examples, while the member 612 is in the second orientation, a portion of the biasing element 610 and/or the cable 614 can be disposed within the cutout region 624 and at least momentarily intersect an axis of rotation (see FIGS. 5A-5H) of the member 612.

As the member 612 rotates from the first orientation or first configuration to the second orientation or second configuration, a protrusion 632 extending from the base portion 618 can rotate to be disposed adjacent or near the second arm 630 of the secondary biasing element 626 (see FIG. 6D). For example, the arrow rest 600 can be coupled to an archery bow such that the member 612 is rotated between the various orientations (e.g., first, second, and third orientations) when the bowstring is drawn and released by an archer (e.g., a limb-driven or drop-away arrow rest).

FIG. 6E shows the arrow rest 600 in the third state or third configuration. In the third state, the member 612 can be disposed in the third orientation and the secondary biasing element 626 can apply or induce a second torque that biases the member 612 to rotate back to the second orientation. In some examples, while the member 612 is transitioning or rotating to the third orientation, the protrusion 632 of the member 612 can rotate into contact with the second arm 630 to tension the secondary biasing element 626 (see FIG. 6F). The tension generated in the secondary biasing element 626 can induce a second torque on the member 612. The second torque can cause the member 612 to rotate from the third orientation, past the second orientation, to the first orientation when the archer releases the bowstring to launch a projectile. In other words, the second torque can generate a momentum of the member 612 sufficient to overcome the first torque induced on the member 612 in the second orientation and enable the member 612 to continue rotating from the third orientation to the first orientation. If the archer lets the bowstring down slowly (e.g., does not launch a projectile), the secondary biasing element 626 may not generate a momentum of the member 612 sufficient to overcome the first torque induced on the member 612 in the second orientation and enable the member 612 to continue rotating to the first orientation. Rather, the member 612 can return to the second orientation and the arrow support 606 can remain in a vertical position in anticipation of subsequently launching the projectile.

In some examples, an energy state or total energy induced on the member 612 can vary relative to the state or configuration of the arrow rest 600 (see Equations 3 through 6 above). For example, the second state or second configuration of the arrow rest 600 (e.g., the second orientation of the member 612) can have a correlating energy induced on the member 612 by the primary biasing element 610. Similarly, the third state or third configuration of the arrow rest 600 (e.g., the third orientation of the member 612) can have a correlating energy induced on the member 612 by the combination of the primary biasing element 610 and the secondary biasing element 626 (e.g., a resultant energy). The energy state or total energy induced on the member 612 in the second orientation can be relatively less than the energy state or total energy induced on the member 612 in the third orientation. In other words, additional energy can be added to the member 612 in the third orientation such that the member 612 may, in some use cases, overcome the energy state associated with the second orientation to return to the first orientation.

Figure 7A:
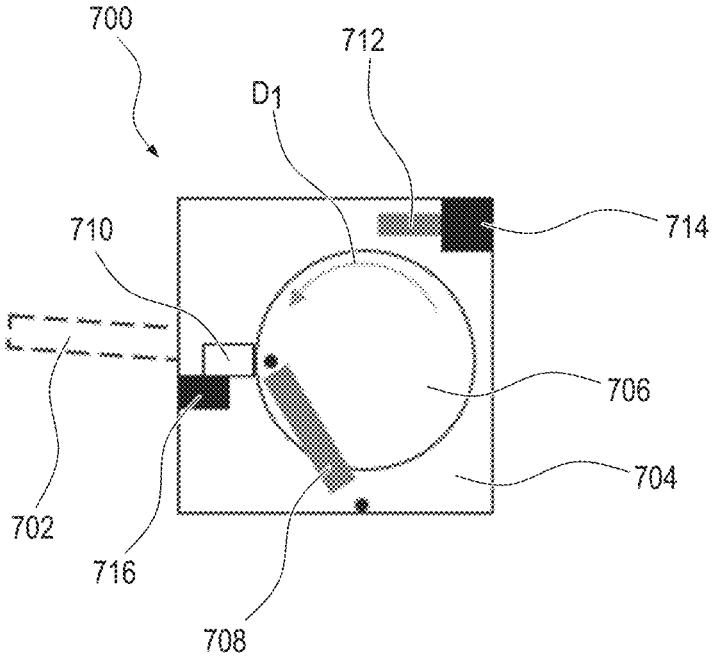
FIG. 7A shows a side view of an arrow rest in a first state, according to some embodiments.

FIG. 7A shows an arrow rest 700 in a first state or first configuration. The arrow rest 700 includes an arrow support 702 and a housing 704. The arrow rest 700 can include a member 706 at least partially disposed within a volume or cavity defined by the housing 704. The member 706 can be operatively coupled to a primary biasing element 708. For example, the primary biasing element 708 can be a tension spring (e.g., a coil spring, an elastic band, etc.) that applies a torque biasing the member 706 to rotate in a first direction $D_1$ while the member 706 is in a first orientation (i.e., the arrow rest 700 is in the first state or first configuration). In some examples, the primary biasing element 708 can be pinned, fastened, adhered, affixed, or otherwise coupled to the member 706 at a first end and pinned, fastened, adhered, affixed, or otherwise coupled to the housing 704 at a second end. While not explicitly shown in FIGS. 7A-7D, the member 706 can be rotatable about an axis of rotation as described herein with reference to FIGS. 5A-5H.

Figure 7B:
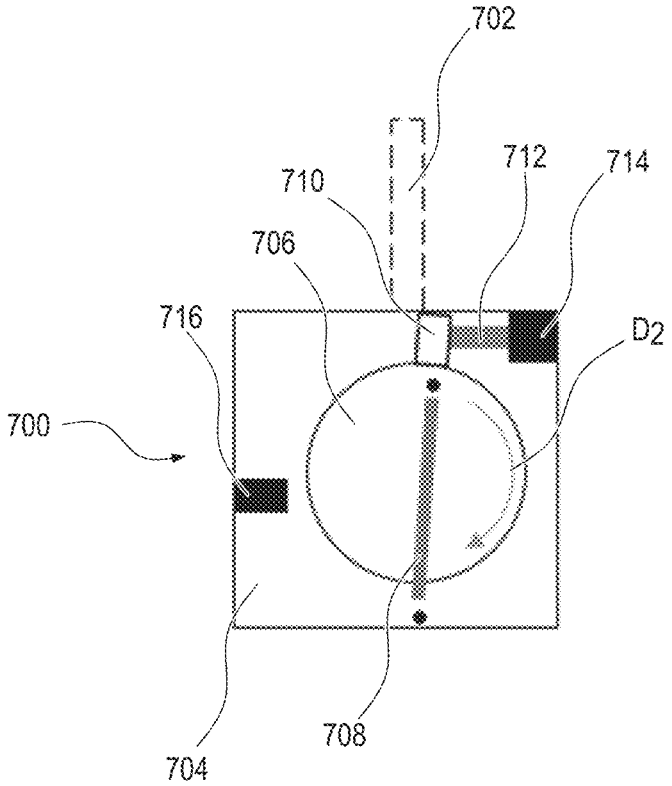
FIG. 7B shows a side view of the arrow rest in a second state, according to some embodiments.

The arrow rest 700 can be affixed or otherwise coupled to an archery bow such that a projectile (e.g., an arrow) is supported by the arrow rest 700 prior to and during launch. When an archer draws a bowstring of the archery bow, a cord or other component can cause the member 706 to overcome the torque induced by the primary biasing element 708 to rotate from the first orientation (see FIG. 7A) to a second orientation (see FIG. 7B). FIG. 7B shows the arrow rest 700 in a second state or second configuration. While the member 706 is in the second orientation, the primary biasing element 708 can induce a torque biasing the member 706 to remain in the second orientation. In some examples, the member 706 includes a feature 710 that contacts or nearly contacts a secondary biasing element 712 while the member 706 is in the second orientation. The feature 710 can be a protrusion, projection, shelf, arm, magnet, a combination thereof, or some other feature of the member 706 arranged and formed to engage the secondary biasing element 712. In some examples, the feature 710 can be integrally or singularly formed with the member 712. In some examples, the secondary biasing element 712 can be a compression spring, a tension spring, a torsion spring, a leaf spring, a magnet, a gas shock, a combination thereof, or any other type of spring or biasing element.

In some examples, the secondary biasing element 712 can be coupled to the housing 704. For example, the housing 704 can include a feature 714, such as, a mount, pin, hub, a combination thereof, or other structure to retain and/or support the secondary biasing element 712 in a fixed position. Alternatively, the secondary biasing element 712 can be coupled to the member 706 in some examples and rotate into contact with one or more features 714 of the housing 704 as the member is rotated. While the primary and secondary biasing elements 708, 712 are shown in FIGS. 7A-7D as extending substantially non-parallel to one another, in other embodiments, the primary and secondary biasing elements 708, 712 can extend substantially parallel to one another.

Figure 7C:
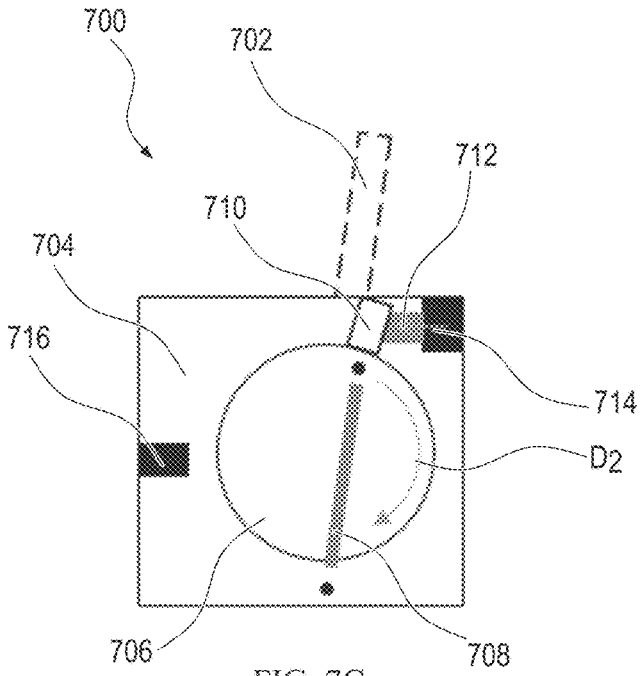
FIG. 7C shows a side view of the arrow rest in a third state, according to some embodiments.
Figure 7D:
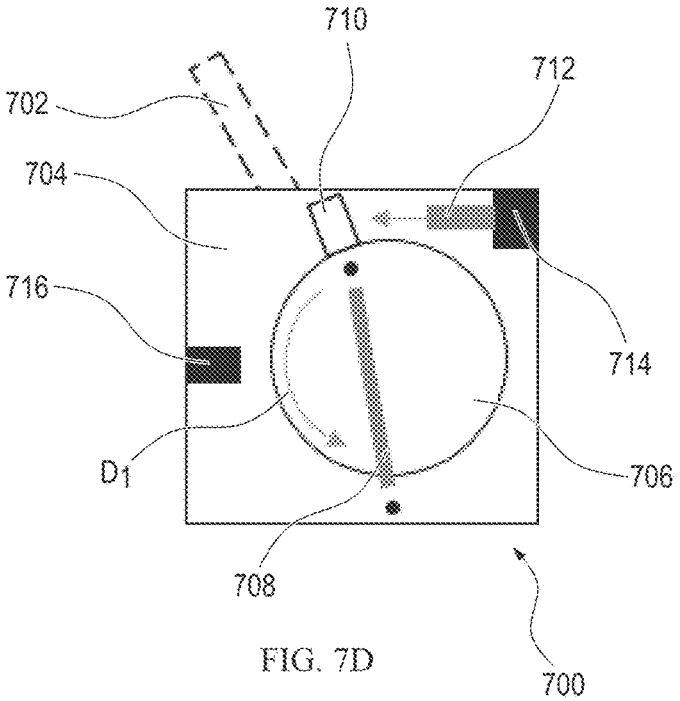
FIG. 7D shows a side view of the arrow rest transitioning from the third state to the first state, according to some embodiments.

As shown in FIG. 7C and FIG. 7D, the primary biasing element 708 can induce a toque inducing the member 706 to rotate in a second direction $D_2$ while the member 706 is in the third orientation. Meanwhile, the secondary biasing element 712 can apply another torque biasing the member 706 to rotate in the first direction $D_1$ while the member 706 is in a third orientation (i.e., the arrow rest 700 is in the third state or third configuration). In other words, the secondary biasing member 712 can compress or otherwise generate energy to bias the member 706 to rotate back to the first or second orientations when the arrow rest 700 is in the third state or third configuration. For example, if the archer lets down the bowstring relatively slowly, the member 706 may not generate a momentum sufficient to overcome the torque (i.e., a minimum threshold torque) applied to the member 706 by the primary biasing member 708 when the member 706 rotates in the first direction $D_1$ back to the second orientation. If the archer lets the bowstring down relatively quickly (e.g., lets the bowstring go to launch a projectile), the member 706 can generate a momentum sufficient to overcome the torque (i.e., a minimum threshold torque) applied to the member 706 by the primary biasing member 708 when the member 706 rotates in the first direction $D_1$, past the second orientation, to the first orientation.

In some examples, the arrow rest 700 can include a stop feature 716 arranged to contact the member 706 or another component of the arrow rest 700 to act as a stop or brake to limit rotation of the member 706 in the first direction $D_1$ past the first orientation (see FIG. 7A). For example, the stop feature 716 can be a flexible member positioned within the housing 704 to contact the feature 710 when the member 706 rotates into the first orientation (i.e., the arrow rest 700 rotates from the second or third state to the first state). In some examples, a spring constant, magnetic force, or other parameter of the primary or secondary biasing elements 708, 712 can be chosen to influence a speed, vibration, noise level, or other characteristic attributable to the arrow rest 700 as the member 706 rotates between the first, second, and third orientations. For example, one or more of the primary and secondary biasing members 708, 712 can be repositionable via a fastener (e.g., a set screw) to vary a characteristic of the arrow rest 700.

Aspects of the present disclosure can be applied to all types of archery arrow rests. For example, one type of archery arrow rest operates on the principle of actuating operation of a drop-away or fall-away feature of the arrow rest via a draw cord coupled to a cable of the archery bow (e.g., a cable-driven arrow rest). When the archery bow is drawn, the cable applies a tension to the cord to rotate one or more components of the arrow rest. Aspects of the present disclosure can be applied to cable-driven arrow rests. Another example of an archery arrow rest operates on the principle of actuating operation of an arrow rest by reducing tension on a draw cord as the archery bow is drawn. This can be accomplished by affixing the draw cord of the rest to a limb of the archery bow (e.g., a limb-driven arrow rest). When the archery bow is drawn, a distal end of the limb can move toward the arrow and therefore decrease a distance between the arrow rest and the distal end of the limb. This reduction in distance can be used to take the tension out of the draw cord to operate the arrow rest. Aspects of the present disclosure can be applied to limb-driven arrow rests.

Changes may be made in the function and arrangement of archery components or products discussed without departing from the spirit and scope of the disclosure, and various embodiments may omit, substitute, or add other components or accessories as appropriate. For instance, one or more features incorporated into a particular component described with respect to certain embodiments may be combined in other embodiments.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An arrow rest for an archery bow, comprising:
a housing defining an internal volume;
a biasing element disposed within the internal volume;
a connector cable or linkage comprising a first end portion coupled to the biasing element and a second end portion opposite the first end portion;
a member coupled to the second end portion and rotatable about an axis of rotation in a first direction from a first orientation to a second orientation, the biasing element applying a first torque on the member biasing the member to remain in the second orientation, the member being rotatable in the first direction from the second orientation to a third orientation, and the biasing element applying a second torque on the member in the third orientation biasing the member to rotate in a second direction; and
an arrow support coupled to the member, wherein:
the member defines a cutout region; and
the connector cable or linkage is movably positionable in and out of the cutout region.

2. The arrow rest of claim 1, wherein:
the member is rotatable in the second direction from the third orientation to the second orientation; and
the second torque generates an angular momentum sufficient to overcome the first torque to rotate the member in the second direction from the third orientation, past the second orientation, to the first orientation.

3. The arrow rest of claim 1, wherein:
the biasing element is a first biasing element and the arrow rest further comprises a second biasing element;
the member contacts the second biasing element in the third orientation;
the member is rotatable in a second direction from the third orientation to the second orientation; and
the second biasing element is configured to generate an angular momentum of the member sufficient to overcome the first torque to rotate the member in the second direction from the third orientation, past the second orientation, to the first orientation.

4. The arrow rest of claim 1, wherein the connector cable or linkage is pivotally coupled to the member.

5. The arrow rest of claim 1, wherein the member comprises a protrusion extending from the member.

6. The arrow rest of claim 5, wherein:

the protrusion is offset a distance from the axis of rotation; and at least one of the biasing element or the connector cable or linkage contacts the protrusion in the third orientation.

7. The arrow rest of claim 1, wherein the biasing element is a spring comprising a first spring end coupled to the housing and a second spring end coupled to the first end of the connector cable or linkage.

8. The arrow rest of claim 1, wherein:

the connector cable or linkage is positioned within the cutout region when the member is in the third orientation.

9. An arrow rest for an archery bow, comprising:

a housing defining an internal volume;

a biasing element;

a member disposed within the internal volume and rotatable about an axis of rotation, the member including a protrusion offset from the axis of rotation, wherein:

in a first configuration, the member is rotatable in a first direction;

in a second configuration, the biasing element induces a torque biasing the member to remain stationary; and in a third configuration, the biasing element contacts and is deflected by the protrusion to bias the member to rotate in a second direction different from the first direction; and an arrow support coupled to the member.

10. The arrow rest of claim 9, wherein:

the arrow support is in a first orientation relative to the housing while the member is in the first configuration;

the arrow support is in a second orientation relative to the housing while the member is in the second configuration; and the arrow support is in a third orientation relative to the housing while the member is in the third configuration.

11. The arrow rest of claim 9, wherein the biasing element is at least partially disposed within the internal volume.

12. The arrow rest of claim 9, wherein the member is configured to rotate at least 70 degrees when the member transitions between the first configuration and the second configuration.

13. The arrow rest of claim 9, wherein the biasing element is a torsion spring or a tension spring.

14. The arrow rest of claim 9, wherein the member comprises:

a base portion;

a stand-off coupled to the base portion, the base portion and the stand-off forming an undercut region; and an engagement portion coupled to the stand-off.

15. The arrow rest of claim 9, wherein:

the torque correlates to a minimum threshold to rotate the member in the second direction from the third configuration to the first configuration; and the member generates a momentum while rotating in the second direction that is greater than the minimum threshold.

16. The arrow rest of claim 9, wherein:

the biasing element is a first biasing element and the arrow rest further comprises a second biasing element;

the member contacts the second biasing element in the third configuration; and the second biasing element is configured to generate an angular momentum of the member sufficient to overcome the torque to rotate the member in the second direction from the third configuration, past the second configuration, to the first configuration.

17. An arrow rest for an archery bow, comprising:

a housing defining an internal volume;

a biasing element disposed within the internal volume;

a member having an undercut region, the member coupled to the biasing element and rotatable about an axis of rotation in a first direction, the biasing element applying a torque on the member; and an arrow support coupled to the member;

wherein:

a direction of rotation the torque induces the member to rotate is dependent on the orientation of the member; and rotation of the member in the first direction disposes the biasing element within the undercut region.

18. The arrow rest of claim 17, wherein:

the biasing element is a primary biasing element and the arrow rest further comprises a secondary biasing element;

the member is rotatable from a first orientation to a second orientation;

the member is rotatable from the second orientation to a third orientation;

the member contacts the secondary biasing element in the third orientation;

the secondary biasing element is configured to generate an angular momentum of the member sufficient to rotate the member from the third orientation, past the second orientation, to the first orientation.

19. The arrow rest of claim 18, wherein the primary biasing element is a tension spring and the secondary biasing element is a compression spring or a magnet.

20. The arrow rest of claim 18, wherein the primary biasing element is a tension spring and the secondary biasing element is a torsion spring.

* * * * *